US010360801B2

(12) United States Patent
Taylor et al.

(10) Patent No.: US 10,360,801 B2
(45) Date of Patent: Jul. 23, 2019

(54) SYSTEMS AND METHODS FOR DEPARTURE ROUTING

(71) Applicant: The MITRE Corporation, McLean, VA (US)

(72) Inventors: Christine Taylor, Washington, DC (US); Tudor Masek, Silver Spring, MD (US); Craig Wanke, McLean, VA (US)

(73) Assignee: The MITRE Corporation, McLean, VA (US)

( * ) Notice: Subject to any disclaimer, the term of this patent is extended or adjusted under 35 U.S.C. 154(b) by 83 days.

(21) Appl. No.: 15/199,218

(22) Filed: Jun. 30, 2016

(65) Prior Publication Data

US 2018/0005531 A1 Jan. 4, 2018

(51) Int. Cl.
*G08G 5/00* (2006.01)

(52) U.S. Cl.
CPC ..... *G08G 5/0039* (2013.01); *G08G 5/0021* (2013.01); *G08G 5/0034* (2013.01); *G08G 5/0091* (2013.01)

(58) Field of Classification Search
None
See application file for complete search history.

(56) References Cited

U.S. PATENT DOCUMENTS

| | | | |
|---|---|---|---|
| 6,573,888 | B2 | 6/2003 | Hayashi et al. |
| 7,720,630 | B1 | 5/2010 | Miller et al. |
| 7,813,871 | B2 | 10/2010 | Small et al. |
| 7,979,200 | B2 | 7/2011 | Bay et al. |
| 8,054,214 | B2 | 11/2011 | Bunch |
| 8,290,696 | B1 | 10/2012 | Sridhar et al. |
| 8,315,787 | B2 | 11/2012 | Shafaat et al. |
| 8,368,584 | B2 | 2/2013 | Askelson et al. |
| 8,471,727 | B2 | 6/2013 | Batsakes et al. |
| 8,674,854 | B2 | 3/2014 | Lee et al. |

(Continued)

FOREIGN PATENT DOCUMENTS

| | | |
|---|---|---|
| CN | 101533563 | 9/2009 |
| JP | 5118588 | 1/2013 |

OTHER PUBLICATIONS

Masalonis, Anthony et al., Oct. 2008, "Integrated Departure Route Planning," Digital Avionics Systems Conference, IEEE/AIAA 27$^{th}$; 12 pages.

(Continued)

*Primary Examiner* — Christian Chace
*Assistant Examiner* — Edward Torchinsky
(74) *Attorney, Agent, or Firm* — Morrison & Foerster LLP

(57) ABSTRACT

System including one or more programs with instructions for storing a plurality of planned departures associated with departure routes and departure fixes in the memory, storing at least one constraint associated with one or more of the departure routes and departure fixes in the memory, generating a departure model for modifying the plurality of planned departures based on the at least one constraint, wherein the departure model comprises a directed graph representing the planned departures, the departure routes, and the departure fixes, determining an optimized set of flows through the departure model based on the at least one constraint, and identifying a reroute for at least one planned departure based on the optimized set of flows.

34 Claims, 18 Drawing Sheets

(56) References Cited

U.S. PATENT DOCUMENTS

| | | | | |
|---|---|---|---|---|
| 8,874,288 | B1 | 10/2014 | Siddiqui | |
| 8,977,482 | B2 | 3/2015 | Ballin et al. | |
| 9,014,880 | B2 | 4/2015 | Durling et al. | |
| 9,069,077 | B2 | 6/2015 | Hartley et al. | |
| 9,135,829 | B2 | 9/2015 | Shafaat et al. | |
| 9,159,240 | B2 | 10/2015 | Cornell et al. | |
| 2008/0030375 | A1 | 2/2008 | Cotton et al. | |
| 2012/0232785 | A1 | 9/2012 | Wiesemann et al. | |
| 2012/0274484 | A1 | 11/2012 | Zimmer et al. | |
| 2013/0027226 | A1 | 1/2013 | Cabos | |
| 2014/0039733 | A1 | 2/2014 | Ren et al. | |
| 2014/0039734 | A1 | 2/2014 | Ramaiah et al. | |
| 2014/0200752 | A9 | 7/2014 | Lacombe et al. | |
| 2014/0306950 | A1 | 10/2014 | Russi et al. | |
| 2014/0372018 | A1 | 12/2014 | Srinivasan et al. | |
| 2015/0310747 | A1 | 10/2015 | Frolik et al. | |
| 2016/0104383 | A1* | 4/2016 | Chandran | G08G 5/0043 701/120 |

OTHER PUBLICATIONS

Song, Lixia et al., Sep. 2009, "Integrated Collaborative Departure Traffic Management," Aviation Technology Integration and Operations Conference; 13 pages.

DeArmon, James et al., Oct. 2010, "Benefits Analysis of a Routing Aid for New York Area Departures," Digital Avionics Systems Conference, IEEE/AIAA 29$^{th}$; 8 pages.

DeLaura, Rich et al., Oct. 2011, "Estimating the Likelihood of Success in Departure Management Strategies During Convective Weather," Digital Avionics Systems Conference, IEEE/AIAA 30$^{th}$; 13 pages.

Song, Lixia et al., Oct. 2011, "Reinventing High Density Area Departure Traffic Management," Digital Avionics Systems Conference, IEEE/AIAA 30$^{th}$; 13 pages.

Zelinski, Shannon et al., Oct. 2014, "A Framework for Integrating Arrival, Departure, and Surface Operations Scheduling," Digital Avionics Systems Conference, IEEE/AIAA 33$^{rd}$; 17 pages.

* cited by examiner

410

| FLIGHT | PLANNED ROUTE | ALTERNATE ROUTES |
|---|---|---|
| A | ALPHA | BETA, GAMMA |
| B | BETA | |
| C | GAMMA | |
| D | GAMMA | |

470

| FLIGHT | OPTIMAL ROUTE |
|---|---|
| A | BETA |
| B | BETA |
| C | GAMMA |
| D | GAMMA |

472

| FIX | 2345 | 0000 | 0015 | 0030 | TOTAL |
|---|---|---|---|---|---|
| HAPIE | 0 | 1 | 2 | 0 | 3 |
| BETTE | 1 | 1 | 7 | 1 | 10 |
| BEADS | 1 | 0 | 0 | 0 | 1 |
| BDR | 0 | 0 | 0 | 0 | 0 |
| BAYYS | 0 | 0 | 0 | 0 | 0 |
| MERIT | 3 | 3 | 11 | 1 | 18 |
| SOARS | 0 | 0 | 0 | 0 | 0 |
| GREKI | 3 | 0 | 2 | 1 | 6 |
| CMK | 0 | 0 | 0 | 0 | 0 |
| GAYEL | 7 | 2 | 2 | 6 | 17 |
| BREZY | 2 | 1 | 0 | 0 | 3 |
| HAAYS | 0 | 0 | 0 | 0 | 0 |
| NEION | 1 | 0 | 0 | 2 | 3 |
| COATE | 5 | 7 | 6 | 4 | 22 |
| DEEZZ | 0 | 0 | 0 | 0 | 0 |
| ELIOT | 2 | 0 | 0 | 0 | 2 |
| DANNR | 0 | 0 | 0 | 0 | 0 |
| NEWEL | 5 | 2 | 2 | 4 | 13 |
| CANDR | 3 | 0 | 1 | 0 | 4 |
| BTRIX | 0 | 0 | 0 | 0 | 0 |
| ZIMMZ | 6 | 1 | 1 | 4 | 12 |
| PARKE | 3 | 3 | 1 | 3 | 10 |
| LANNA | 9 | 4 | 8 | 6 | 27 |
| BIGGY | 1 | 0 | 0 | 5 | 6 |
| RBV | 2 | 0 | 6 | 0 | 8 |
| DIXIE | 1 | 3 | 1 | 0 | 5 |
| WHITE | 1 | 1 | 3 | 5 | 10 |
| WAVEY | 0 | 0 | 2 | 1 | 3 |
| SHIPP | 2 | 1 | 5 | 0 | 8 |
| SERMN | 0 | 0 | 0 | 0 | 0 |
| DUCT | 0 | 0 | 0 | 0 | 0 |
| OTHER | 15 | 9 | 21 | 11 | 56 |
| MXE6 | 0 | 1 | 0 | 0 | 1 |
| MXE80 | 0 | 0 | 0 | 0 | 0 |
| PTW60 | 0 | 1 | 1 | 3 | 5 |

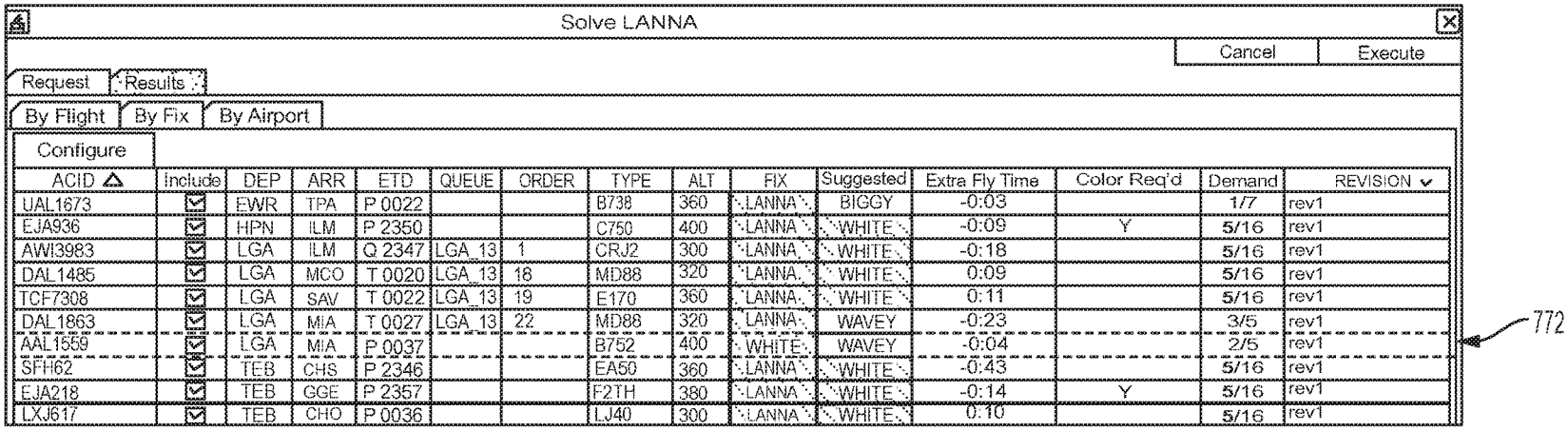

| ACID | Include | DEP | ARR | ETD | QUEUE | ORDER | TYPE | ALT | FIX | Suggested | Extra Fly Time | Color Req'd | Demand | REVISION |
|---|---|---|---|---|---|---|---|---|---|---|---|---|---|---|
| UAL1673 | ☑ | EWR | TPA | P 0022 | | | B738 | 360 | LANNA | BICGY | -0:03 | | 1/7 | rev1 |
| EJA936 | ☑ | HPN | ILM | P 2350 | | | C750 | 400 | LANNA | WHITE | -0:09 | Y | 5/16 | rev1 |
| AWI3983 | ☑ | LGA | ILM | Q 2347 | LGA_13 | 1 | CRJ2 | 300 | LANNA | WHITE | -0:18 | | 5/16 | rev1 |
| DAL1485 | ☑ | LGA | MCO | T 0020 | LGA_13 | 18 | MD88 | 320 | LANNA | WHITE | 0:09 | | 5/16 | rev1 |
| TCF7308 | ☑ | LGA | SAV | T 0022 | LGA_13 | 19 | E170 | 360 | LANNA | WHITE | 0:11 | | 5/16 | rev1 |
| DAL1863 | ☑ | LGA | MIA | T 0027 | LGA_13 | 22 | MD88 | 320 | LANNA | WAVEY | -0:23 | | 3/5 | rev1 |
| AAL1559 | ☑ | LGA | MIA | P 0037 | | | B752 | 400 | WHITE | WAVEY | -0:04 | | 2/5 | rev1 |
| SFH62 | ☑ | TEB | CHS | P 2346 | | | EA50 | 360 | LANNA | WHITE | -0:43 | | 5/16 | rev1 |
| EJA218 | ☑ | TEB | GGE | P 2357 | | | F2TH | 380 | LANNA | WHITE | -0:14 | Y | 5/16 | rev1 |
| LXJ617 | ☑ | TEB | CHO | P 0036 | | | LJ40 | 300 | LANNA | WHITE | 0:10 | | 5/16 | rev1 |

FIG. 7D

Request | Results

By Flight | By Fix | By Airport

700

Fix Demand (before)

| FIX | 2345 | 0000 | 0015 | 0030 | TOTAL |
|---|---|---|---|---|---|
| HAPIE | 0 | 1 | 2 | 0 | 3 |
| BETTE | 1 | 1 | 7 | 1 | 10 |
| BEADS | 1 | 0 | 0 | 0 | 1 |
| BDR | 0 | 0 | 0 | 0 | 0 |
| BAYYS | 0 | 0 | 0 | 0 | 0 |
| MERIT | 3 | 3 | 11 | 1 | 18 |
| SOARS | 0 | 0 | 0 | 0 | 0 |
| GREKI | 3 | 0 | 2 | 1 | 6 |
| CMK | 0 | 0 | 0 | 0 | 0 |
| GAYEL | 7 | 2 | 2 | 6 | 17 |
| BREZY | 2 | 1 | 0 | 0 | 3 |
| HAAYS | 0 | 0 | 0 | 0 | 0 |
| NEION | 1 | 0 | 0 | 2 | 3 |
| COATE | 5 | 7 | 6 | 4 | 22 |
| DEEZZ | 0 | 0 | 0 | 0 | 0 |
| ELIOT | 2 | 0 | 0 | 0 | 2 |
| DANNR | 0 | 0 | 0 | 0 | 0 |
| NEWEL | 5 | 2 | 2 | 4 | 13 |
| CANDR | 3 | 0 | 1 | 0 | 4 |
| BTRIX | 0 | 0 | 0 | 0 | 0 |
| ZIMMZ | 6 | 1 | 1 | 4 | 12 |
| PARKE | 3 | 3 | 1 | 3 | 10 |
| LANNA | 9 | 4 | 8 | 6 | 27 |
| BIGGY | 1 | 0 | 0 | 5 | 6 |
| RBV | 2 | 0 | 6 | 6 | 8 |
| DIXIE | 1 | 3 | 1 | 0 | 5 |
| WHITE | 1 | 1 | 3 | 5 | 10 |
| WAVEY | 0 | 0 | 2 | 1 | 3 |
| SHIPP | 2 | 1 | 5 | 0 | 8 |
| SERMN | 0 | 0 | 0 | 0 | 0 |
| DUCT | 0 | 0 | 0 | 0 | 0 |
| OTHER | 15 | 9 | 21 | 11 | 56 |
| MXE6 | 0 | 1 | 0 | 0 | 1 |

780

Fix Demand (before)

| FIX | 2345 | 0000 | 0015 | 0030 | TOTAL |
|---|---|---|---|---|---|
| HAPIE | 0 | 1 | 2 | 0 | 3 |
| BETTE | 1 | 1 | 7 | 1 | 10 |
| BEADS | 1 | 0 | 0 | 0 | 1 |
| BDR | 0 | 0 | 0 | 0 | 0 |
| BAYYS | 0 | 0 | 0 | 0 | 0 |
| MERIT | 3 | 3 | 11 | 1 | 18 |
| SOARS | 0 | 0 | 0 | 0 | 0 |
| GREKI | 3 | 0 | 2 | 1 | 6 |
| CMK | 0 | 0 | 0 | 0 | 0 |
| GAYEL | 7 | 2 | 2 | 6 | 17 |
| BREZY | 2 | 1 | 0 | 0 | 3 |
| HAAYS | 0 | 0 | 0 | 0 | 0 |
| NEION | 1 | 0 | 0 | 2 | 3 |
| COATE | 5 | 7 | 6 | 4 | 22 |
| DEEZZ | 0 | 0 | 0 | 0 | 0 |
| ELIOT | 2 | 0 | 0 | 0 | 2 |
| DANNR | 0 | 0 | 0 | 0 | 0 |
| NEWEL | 5 | 2 | 2 | 4 | 13 |
| CANDR | 3 | 0 | 1 | 0 | 4 |
| BTRIX | 0 | 0 | 0 | 0 | 0 |
| ZIMMZ | 6 | 1 | 1 | 4 | 12 |
| PARKE | 3 | 3 | 1 | 3 | 12 |
| LANNA | 5 | 4 | 4 | 5 | 18 |
| BIGGY | 1 | 0 | 1 | 5 | 7 |
| RBV | 2 | 0 | 6 | 0 | 8 |
| DIXIE | 1 | 3 | 1 | 0 | 5 |
| WHITE | 5 | 1 | 5 | 5 | 16 |
| WAVEY | 0 | 0 | 3 | 2 | 5 |
| SHIPP | 2 | 1 | 5 | 0 | 8 |
| SERMN | 0 | 0 | 0 | 0 | 0 |
| DUCT | 0 | 0 | 0 | 0 | 0 |
| OTHER | 15 | 9 | 21 | 11 | 56 |
| MXE6 | 0 | 1 | 0 | 0 | 1 |

FIG. 7E

Solve LANNA+BIGGY

Cancel | Execute

Request | Results

By Flight | By Fix | By Airport

Configure

| ACID | Include | DEP | ARR | ETD | QUEUE | ORDER | TYPE | ALT | FIX | Suggested | Extra Fly Time | Color Req'd | Demand | REVISION |
|---|---|---|---|---|---|---|---|---|---|---|---|---|---|---|
| ASQ3816 | ☑ | EWR | BNA | Q 0000 | EWR_... | 6 | E145 | 360 | LANNA+BIGGY | PARKE | -0:02 | | 4/11 | rev1 |
| AWI3983 | ☑ | LGA | ILM | Q 2347 | LGA_13 | 1 | CRJ2 | 300 | LANNA+BIGGY | WHITE | -0:18 | | 5/16 | rev1 |
| DAL1435 | ☑ | LGA | TPA | P 0037 | | | MD88 | 320 | LANNA+BIGGY | SHIPP | 0:22 | | 1/9 | rev1 |
| DAL1485 | ☑ | LGA | MCO | T 0020 | LGA_13 | 18 | MD88 | 320 | LANNA+BIGGY | WHITE | -0:09 | | 5/16 | rev1 |
| DAL1863 | ☑ | LGA | MIA | T 0027 | LGA_13 | 22 | MD88 | 320 | LANNA+BIGGY | WAVEY | -0:23 | | 3/5 | rev1 |
| EJA218 | ☑ | TEB | GGE | P 2357 | | | F2TH | 380 | LANNA+BIGGY | WHITE | -0:14 | Y | 5/16 | rev1 |
| EJA936 | ☑ | HPN | ILM | P 2350 | | | C750 | 400 | LANNA+BIGGY | WAVEY | -0:06 | Y | 1/5 | rev1 |
| N511QS | ☑ | HPN | BQK | P 2348 | | | GLF5 | 380 | LANNA+BIGGY | WHITE | -0:07 | Y | 5/16 | rev1 |
| SFH62 | ☑ | TEB | CHS | P 2346 | | | EA50 | 360 | LANNA+BIGGY | WHITE | -0:43 | | 5/16 | rev1 |
| TCF7308 | ☑ | LGA | SAV | T 0022 | LGA_13 | 19 | E170 | 360 | LANNA+BIGGY | WHITE | -0:11 | | 5/16 | rev1 |

FIG. 8B

Solve LANNA

Request | Results

By Flight | By Fix | By Airport

700

Fix Demand (before)

| FIX | 2345 | 0000 | 0015 | 0030 | TOTAL |
|---|---|---|---|---|---|
| HAPIE | 0 | 1 | 2 | 0 | 3 |
| BETTE | 1 | 1 | 7 | 1 | 10 |
| BEADS | 2 | 0 | 0 | 0 | 1 |
| BDR | 0 | 0 | 0 | 0 | 0 |
| BAYYS | 0 | 0 | 0 | 0 | 0 |
| MERIT | 3 | 3 | 11 | 1 | 18 |
| SOARS | 0 | 0 | 0 | 0 | 0 |
| GREKI | 3 | 0 | 2 | 1 | 6 |
| CMK | 0 | 0 | 0 | 0 | 0 |
| GAYEL | 7 | 2 | 2 | 6 | 17 |
| BREZY | 2 | 1 | 0 | 0 | 3 |
| HAAYS | 0 | 0 | 0 | 0 | 0 |
| NEION | 1 | 0 | 0 | 2 | 3 |
| COATE | 5 | 7 | 6 | 4 | 22 |
| DEEZZ | 0 | 0 | 0 | 0 | 0 |
| ELIOT | 2 | 0 | 0 | 0 | 2 |
| DANNR | 0 | 0 | 0 | 0 | 0 |
| NEWEL | 5 | 2 | 2 | 4 | 13 |
| CANDR | 3 | 0 | 1 | 0 | 4 |
| BTRIX | 0 | 0 | 0 | 0 | 0 |
| ZIMMZ | 6 | 1 | 1 | 4 | 12 |
| PARKE | 3 | 3 | 1 | 3 | 10 |
| LANNA | 9 | 4 | 8 | 6 | 27 |
| BIGGY | 1 | 0 | 0 | 5 | 6 |
| RBV | 2 | 0 | 6 | 0 | 8 |
| DIXIE | 1 | 3 | 1 | 0 | 5 |
| WHITE | 1 | 1 | 3 | 5 | 10 |
| WAVEY | 0 | 0 | 2 | 1 | 3 |
| SHIPP | 2 | 1 | 5 | 0 | 8 |
| SERMN | 0 | 0 | 0 | 0 | 0 |
| DUCT | 0 | 0 | 0 | 0 | 0 |
| OTHER | 15 | 9 | 21 | 11 | 56 |
| MXE6 | 0 | 1 | 0 | 0 | 1 |

900

Fix Demand (after)

| FIX | 2345 | 0000 | 0015 | 0030 | TOTAL |
|---|---|---|---|---|---|
| HAPIE | 0 | 1 | 2 | 0 | 3 |
| BETTE | 1 | 1 | 7 | 1 | 10 |
| BEADS | 2 | 0 | 0 | 0 | 1 |
| BDR | 0 | 0 | 0 | 0 | 0 |
| BAYYS | 0 | 0 | 0 | 0 | 0 |
| MERIT | 3 | 3 | 11 | 1 | 18 |
| SOARS | 0 | 0 | 0 | 0 | 0 |
| GREKI | 3 | 0 | 2 | 1 | 6 |
| CMK | 0 | 0 | 0 | 0 | 0 |
| GAYEL | 7 | 2 | 2 | 6 | 17 |
| BREZY | 2 | 1 | 0 | 0 | 3 |
| HAAYS | 0 | 0 | 0 | 0 | 0 |
| NEION | 1 | 0 | 0 | 2 | 3 |
| COATE | 5 | 7 | 6 | 4 | 22 |
| DEEZZ | 0 | 0 | 0 | 0 | 0 |
| ELIOT | 2 | 0 | 0 | 0 | 2 |
| DANNR | 0 | 0 | 0 | 0 | 0 |
| NEWEL | 5 | 2 | 2 | 4 | 13 |
| CANDR | 3 | 0 | 1 | 0 | 4 |
| BTRIX | 0 | 0 | 0 | 0 | 0 |
| ZIMMZ | 6 | 1 | 1 | 4 | 12 |
| PARKE | 5 | 3 | 1 | 3 | 12 |
| LANNA | 5 | 4 | 4 | 6 | 19 |
| BIGGY | 1 | 0 | 1 | 5 | 7 |
| RBV | 2 | 0 | 6 | 0 | 8 |
| DIXIE | 1 | 3 | 1 | 0 | 5 |
| WHITE | 3 | 1 | 5 | 5 | 14 |
| WAVEY | 0 | 0 | 3 | 1 | 4 |
| SHIPP | 2 | 1 | 5 | 0 | 8 |
| SERMN | 0 | 0 | 0 | 0 | 0 |
| DUCT | 0 | 0 | 0 | 0 | 0 |
| OTHER | 15 | 9 | 21 | 11 | 56 |
| MXE6 | 0 | 1 | 0 | 0 | 1 |

FIG. 9B

SYSTEMS AND METHODS FOR DEPARTURE ROUTING

STATEMENT REGARDING FEDERALLY SPONSORED RESEARCH OR DEVELOPMENT

This invention was made with Government support under U.S. Government contract DTFAWA10-C-00080 awarded by the U.S. Department of Transportation Federal Aviation Administration. The Government has certain rights in this invention.

FIELD OF THE INVENTION

The present disclosure relates generally to departure routing and more specifically to aircraft departure routing for air traffic control.

BACKGROUND OF THE INVENTION

The presence of convective weather (thunderstorms) in terminal and nearby en route airspace of major airports can have significant impacts on departure operations. Traffic on departure routes impacted by convective weather may be constrained by miles-in-trail (MIT) restrictions to allow controllers the time needed to maneuver individual flights around thunderstorms that pilots wish to avoid. When the workload required to manage traffic flows becomes too great, departure routes may be closed. Departures still on the ground that are scheduled for closed or restricted routes may face significant delays as they wait for clearance on their scheduled route or for a viable reroute to be implemented.

Effective departure management can reduce delays at the most congested airports. Unfortunately, Traffic Management Coordinators (TMCs) often lack the integrated information necessary to effectively manage departures. Therefore, TMCs are left with the difficult task of mentally integrating multiple information sources with flight plans to determine which flights will be impacted and how those flights should be rerouted if necessary. To effectively reroute one or more flights, a TMC should know which routes are available, how those routes impact other departure fixes and routes, the additional flying time required to fly those routes, and a multitude of other factors. Moreover, when selecting reroutes, TMCs must balance competing priorities such as reducing flying time and reducing congestion. In addition, TMCs should quickly coordinate the selected reroutes with multiple control facilities, as well as with flight operators.

Attempts have been made to provide computed departure rerouting solutions based on formulating departure routing as a scheduling problem. For example, Capozzi et al., "Towards Optimal Routing and Scheduling of Metroplex Operations," AIAA Aviation Technology, Integration, and Operations Conference, 21-23 Sep. 2009, Hilton Head, S.C., describes departure scheduling problems for a metroplex, where a metroplex is defined as two or more airports within the same Terminal Radar Approach Control sharing airspace resources. Scheduling problems, or, more specifically, job scheduling problems, are typically formulated as a set of binary decisions that determine the coordinated utilization of shared resources. Inclusion of timing constraints results in a Mixed-Integer Linear Programming (MILP) problem formulation. Given the combinatorial nature of the decisions, the job scheduling problem is of the class of non-deterministic polynomial-time hard (NP-hard) problems, and no polynomial time algorithm for solving such a problem is currently known.

The computation time of problems of this type is dependent on the number of binary variables, where small increases in the problem size can yield large increases in computation time, an effect commonly referred to as "combinatorial explosion." Thus, rerouting solutions based on this type of problem formulation often cannot be used for real world applications in which the number of variables outstrips the ability of such formulations to generate solutions in real time.

BRIEF SUMMARY OF THE INVENTION

Described below are departure rerouting methods and systems that can be used in high-demand situations to produce departure rerouting solutions in real time. In some embodiments a system can automatically determine departure reroutes for departing assets in response to changing operational conditions. According to some embodiments, the system formulates the departure operational conditions using a directed graph model and solves the model to determine optimized reroutes for departures. The system generates a directed graph model, such as a network flow model, by representing planned departures of assets and the departure resources for those assets as nodes of the model and by representing constraints on the use of the resources by the assets as arcs between the nodes of the model. Flows through the network from the source nodes to a demand node over the arcs represent departure routing solutions. The system can associate multipliers with one or more arcs such that some flows will results in higher overall values than other flows. The system generates a solution (set of flows) by solving the model and finding the solution with the lowest total value.

According to some embodiments, a system can determine rerouting of flight departures from a metroplex in which multiple airports utilize the same airspace. The system can determine reroutes for flights when the original routes no longer allow for on-time departures, for example, due to weather impact or air traffic congestion. By formulating the departure rerouting problem using a directed graph model, the system can determine rerouting of the flights in real time using linear optimization methods. The system can automatically and continuously determine reroutes to respond to changes in the operational conditions.

According to some embodiments a system for identifying departure reroutes comprises one or more processors, memory, and one or more programs, wherein the one or more programs are stored in the memory and configured to be executed by the one or more processors. The one or more programs include instructions for storing a plurality of planned departures associated with departure routes and departure fixes in the memory, storing at least one constraint associated with one or more of the departure routes and departure fixes in the memory, generating a departure model for modifying the plurality of planned departures based on the at least one constraint, wherein the departure model comprises a directed graph representing the plurality of planned departures, the departure routes, and the departure fixes, determining an optimized set of flows through the departure model based on the at least one constraint, and identifying a reroute for at least one planned departure based on the optimized set of flows.

In any of these embodiments, the directed graph can be a flow network. In any of these embodiments, the departure model may include a plurality of departure nodes associated with the plurality of planned departures, a plurality of route nodes associated with the departure routes, a plurality of first fix nodes associated with the departure fixes, a plurality of first connections between the plurality of departure nodes and the plurality of route nodes, and a plurality of second connections between the plurality of route nodes and the plurality of first fix nodes, at least one factor assigned to at least one of the first and second connections based on the at least one constraint, and determining an optimized set of flows through the departure model based on the at least one constraint may include determining an optimized set of flows through the departure model based on the plurality of first connections, the plurality of second connections, and the at least one factor.

In any of these embodiments, the plurality of departure nodes, the plurality of route nodes, and the plurality of first fix nodes may be grouped into time bins. In any of these embodiments, connections of the plurality of first connections and the plurality of second connections may be limited to connections between nodes grouped in the same time bin.

In any of these embodiments, the model may include a plurality of second fix nodes associated with the departure fixes, and a plurality of third connections between the plurality of first fix nodes and the plurality of second fix nodes, wherein at least one second fix node may be connected to a first fix node grouped in a first time bin and a first fix node grouped in a second time bin.

In any of these embodiments, a planned departure of the plurality of planned departures may include a planned departure time for an asset to depart a departure location, and a planned departure route for routing the asset from the departure location to a planned departure fix.

In any of these embodiments, the departure location may be a region comprising multiple departure installations. In any of these embodiments, the plurality of route nodes may include at least one node for each first fix node.

In any of these embodiments, the at least one factor may include a limit on a quantity of flows through a node. In any of these embodiments, the at least one constraint may be associated with a weather event.

In any of these embodiments, the model may include multipliers for the connections that represent at least one operational characteristic. In any of these embodiments, the at least one operational characteristic may include at least one of travel time, rerouting, and weather blockage.

In any of these embodiments, determining an optimized set of flows may include determining the optimized set of flows using a linear or network optimization algorithm. In any of these embodiments, the optimized set of flows may include a minimum total value. In any of these embodiments, in response to changes to the at least one constraint, the system may automatically update the departure model and automatically determine an updated optimized set of flows.

According to some embodiments, a method for identifying departure reroutes includes storing a plurality of planned departures associated with departure routes and departure fixes in a memory, storing at least one constraint associated with one or more of the departure routes and departure fixes in the memory, generating, by a processor, a departure model for modifying the plurality of planned departures based on the at least one constraint, wherein the departure model comprises a directed graph representing the planned departures, the departure routes, and the departure fixes, determining, by the processor, an optimized set of flows through the departure model based on the at least one constraint, and identifying a reroute for at least one planned departure based on the optimized set of flows.

In any of these embodiments, the directed graph may be a flow network.

In any of these embodiments, the departure model may include a plurality of departure nodes associated with the plurality of planned departures, a plurality of route nodes associated with the departure routes, a plurality of first fix nodes associated with the departure fixes, a plurality of first connections between the plurality of departure nodes and the plurality of route nodes, and a plurality of second connections between the plurality of route nodes and the plurality of first fix nodes, at least one factor assigned to at least one of the first and second connections based on the at least one constraint, and determining an optimized set of flows through the departure model based on the at least one constraint may include determining an optimized set of flows through the departure model based on the plurality of first connections, the plurality of second connections, and the at least one factor.

In any of these embodiments, the plurality of departure nodes, the plurality of route nodes, and the plurality of first fix nodes may be grouped into time bins. In any of these embodiments, connections of the plurality of first connections and the plurality of second connections may be limited to connections between nodes grouped in the same time bin.

In any of these embodiments, the model may include a plurality of second fix nodes associated with the departure fixes, and a plurality of third connections between the plurality of first fix nodes and the plurality of second fix nodes, wherein at least one second fix node may be connected to a first fix node grouped in a first time bin and a first fix node grouped in a second time bin.

In any of these embodiments, a planned departure may include a planned departure time for an asset to depart a departure location, and a planned departure route for routing the asset from the departure location to a planned departure fix.

In any of these embodiments, the departure location may be a region comprising multiple departure installations. In any of these embodiments, the plurality of route nodes may include at least one node for each first fix node.

In any of these embodiments, the at least one factor may include a limit on a quantity of flows through a node. In any of these embodiments, the at least one constraint may be associated with a weather event.

In any of these embodiments, the model may include multipliers for the connections that represent at least one operational characteristic. In any of these embodiments, the at least one operational characteristic may include at least one of travel time, rerouting, and weather blockage.

In any of these embodiments, determining an optimized set of flows may include determining the optimized set of flows using a linear or network optimization algorithm. In any of these embodiments, the optimized set of flows may include a minimum total value. In any of these embodiments, in response to changes to the at least one constraint, the departure model may be automatically updated and an updated optimized set of flows may be determined.

According to some embodiments, a non-transitory computer readable storage medium comprises one or more programs, which when executed by one or more processors, cause the one or more processors to perform a method comprising storing a plurality of planned departures associated with departure routes and departure fixes in a memory, storing at least one constraint associated with one or more of the departure routes and departure fixes in the memory, generating a departure model for modifying the plurality of planned departures based on the at least one constraint, wherein the departure model comprises a directed graph representing the planned departures, the departure routes, and the departure fixes, determining an optimized set of flows through the departure model based on the at least one constraint, and identifying a reroute for at least one planned departure based on the optimized set of flows.

In any of these embodiments, the directed graph may be a flow network.

In any of these embodiments, the departure model may include a plurality of departure nodes associated with the plurality of planned departures, a plurality of route nodes associated with the departure routes, a plurality of first fix nodes associated with the departure fixes, a plurality of first connections between the plurality of departure nodes and the plurality of route nodes, and a plurality of second connections between the plurality of route nodes and the plurality of first fix nodes, at least one factor assigned to at least one of the first and second connections based on the at least one constraint, and determining an optimized set of flows through the departure model based on the at least one constraint may include determining an optimized set of flows through the departure model based on the plurality of first connections, the plurality of second connections, and the at least one factor.

In any of these embodiments, the plurality of departure nodes, the plurality of route nodes, and the plurality of first fix nodes may be grouped into time bins. In any of these embodiments, connections of the plurality of first connections and the plurality of second connections may be limited to connections between nodes grouped in the same time bin.

In any of these embodiments, the model may include a plurality of second fix nodes associated with the departure fixes, and a plurality of third connections between the plurality of first fix nodes and the plurality of second fix nodes, wherein at least one second fix node may be connected to a first fix node grouped in a first time bin and a first fix node grouped in a second time bin.

In any of these embodiments, a planned departure may include a planned departure time for an asset to depart a departure location, and a planned departure route for routing the asset from the departure location to a planned departure fix.

In any of these embodiments, the departure location may be a region comprising multiple departure installations. In any of these embodiments, the plurality of route nodes may include at least one node for each first fix node.

In any of these embodiments, the at least one factor may include a limit on a quantity of flows through a node. In any of these embodiments, the at least one constraint may be associated with a weather event.

In any of these embodiments, the model may include multipliers for the connections that represent at least one operational characteristic. In any of these embodiments, the at least one operational characteristic may include at least one of travel time, rerouting, and weather blockage.

In any of these embodiments, determining an optimized set of flows may include determining the optimized set of flows using a linear or network optimization algorithm. In any of these embodiments, the optimized set of flows may include a minimum total value. In any of these embodiments, in response to changes to the at least one constraint, the departure model may be automatically updated and an updated optimized set of flows may be determined.

According to some embodiments, a system for managing departures comprises a communication network, a first system connected to the communication network and comprising one or more first processors and first memory, wherein the first system is configured to manage departures by maintaining departure routing information and departure resource information, and a second system connected to the communication network and comprising one or more second processors, second memory, and one or more programs, wherein the one or more programs are stored in the second memory and configured to be executed by the one or more second processors, the one or more programs including instructions for receiving a plurality of planned departures associated with departure routes and departure fixes from the first system, receiving at least one constraint associated with one or more of the departure routes and departure fixes from the first system, generating a departure model for modifying the plurality of planned departures based on the at least one constraint, wherein the departure model comprises a directed graph representing the planned departures, the departure routes, and the departure fixes, determining an optimized set of flows through the departure model based on the at least one constraint, identifying a reroute for at least one planned departure based on the optimized set of flows, and transmitting the identified reroute to the first system over the communication network, wherein the first system updates the departure routing information based on the identified reroute received from the second system.

In any of these embodiments, the directed graph may be a flow network.

In any of these embodiments, the departure model may include a plurality of departure nodes associated with the plurality of planned departures, a plurality of route nodes associated with the departure routes, a plurality of first fix nodes associated with the departure fixes, a plurality of first connections between the plurality of departure nodes and the plurality of route nodes, and a plurality of second connections between the plurality of route nodes and the plurality of first fix nodes, at least one factor assigned to at least one of the first and second connections based on the at least one constraint, and determining an optimized set of flows through the departure model based on the at least one constraint may include determining an optimized set of flows through the departure model based on the plurality of first connections, the plurality of second connections, and the at least one factor.

In any of these embodiments, the plurality of departure nodes, the plurality of route nodes, and the plurality of first fix nodes may be grouped into time bins. In any of these embodiments, connections of the plurality of first connections and the plurality of second connections may be limited to connections between nodes grouped in the same time bin.

In any of these embodiments, the model may include a plurality of second fix nodes associated with the departure fixes, and a plurality of third connections between the plurality of first fix nodes and the plurality of second fix nodes, wherein at least one second fix node may be connected to a first fix node grouped in a first time bin and a first fix node grouped in a second time bin.

In any of these embodiments, a planned departure may include a planned departure time for an asset to depart a departure location, and a planned departure route for routing the asset from the departure location to a planned departure fix.

In any of these embodiments, the departure location may be a region comprising multiple departure installations. In any of these embodiments, the plurality of route nodes may include at least one node for each first fix node.

In any of these embodiments, the at least one factor may include a limit on a quantity of flows through a node. In any of these embodiments, the at least one constraint may be associated with a weather event.

In any of these embodiments, the model may include multipliers for the connections that represent at least one operational characteristic. In any of these embodiments, the at least one operational characteristic may include at least one of travel time, rerouting, and weather blockage.

In any of these embodiments, determining an optimized set of flows may include determining the optimized set of flows using a linear or network optimization algorithm. In any of these embodiments, the optimized set of flows may include a minimum total value. In any of these embodiments, in response to changes to the at least one constraint, the departure model may be automatically updated and an updated optimized set of flows may be determined.

BRIEF DESCRIPTION OF THE DRAWINGS

FIG. 7D illustrates alternate departure routes for the flights on the LANNA fix of FIG. 7A when considering secondary fixes;

FIG. 7E illustrates the before and after fix demand count tables for the LANNA fix congestion alternate routes of FIG. 7D when considering secondary fixes;

FIG. 8B illustrates alternate departure routes for the combined LANNA and BIGGY fix generated for the second example of FIG. 8A;

FIG. 9B illustrates before and after fix demand count tables when considering coordination cost according to the third example of FIG. 9A;

DETAILED DESCRIPTION OF THE INVENTION

Figure 1:
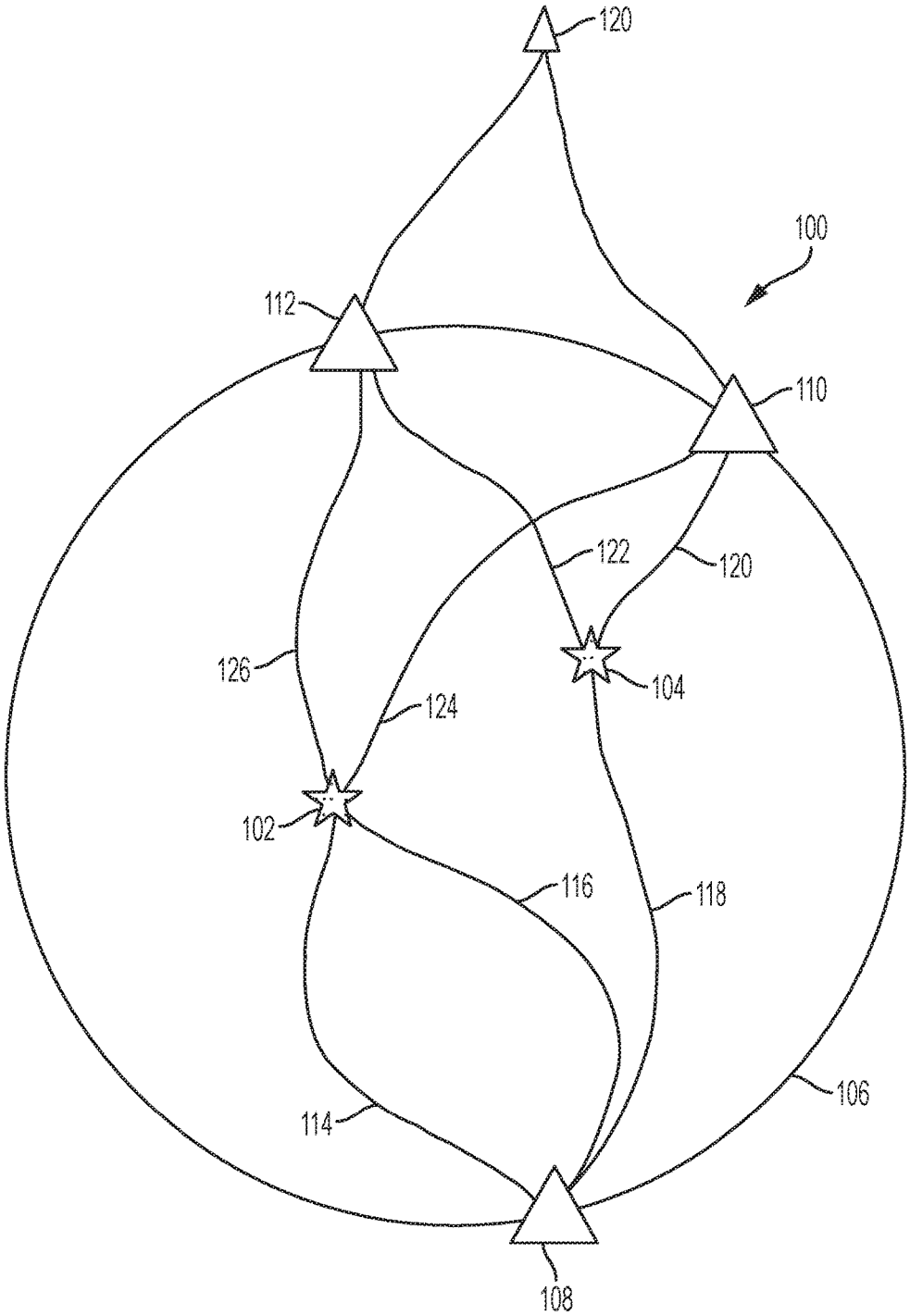
FIG. 1 illustrates an exemplary multi-airport shared airspace that highlights the operational use of embodiments of systems and methods described herein.

Described herein are systems and methods for departure rerouting that can generate optimized reroutes for complex operational situations in real-time. In some embodiments, systems can generate reroutes for flights when the original route no longer allows for an on-time departure, for example, due to weather impact or congestion, or when moving a single flight will reduce delay for later flights. According to some embodiments, the system solves the rerouting problem while taking into account goals such as reducing excess flying time and conforming to operator-preferred routes. These goals are translated into quantifiable metrics and aggregated using relative weights. The resulting objective function can be minimized over the set of reroute options that satisfy the constraints built into the model.

According to some embodiments, the system stores the parameters that define the rerouting problem, builds a model representing the rerouting problem based on the stored parameters, and determines optimized solutions for the model based on stored parameters that represent operational goals. In some embodiments, the system stores parameters such as planned departures, departure resources, constraints on departure resources, and goal metrics. Some or all of the parameters may then be used to build a directed graph model, such as a network flow model (also referred to herein as a flow network), that represents departures and departure resources as nodes and the constraints on departure resources as arcs connecting the nodes. Flows through the directed graph represent departure routing solutions. Metrics may be associated with arcs in the form of multipliers (also referred to herein as factors, costs, and weights) that increase the value of the flows through the arcs such that different solutions have different total values. The system can determine the solution by determining the set of flows with the minimum total value.

According to some embodiments, the system transforms the departure routing problem from a job scheduling formulation into a network flow formulation—i.e., from a mixed-integer linear programming problem (MILP), which may not be solvable in polynomial time, into a network optimization problem that is subsequently solved using linear programming (LP) techniques. Transformation from a MILP to an LP can provide an enormous computational benefit, making the systems viable for real-time decision making. The network flow model can capture departure constraints, including timing effects, and provide exact solutions that require significantly less computational effort than would be required by job scheduling methods.

According to some embodiments, systems assign flights to departure resource options (routes/fixes) such that a minimum cost is associated with the allocation and constraints are satisfied. Given the time-varying nature of the alert thresholds, a time-expanded network model is used that replicates the physical or static network in discrete time steps, enabling the capture of time-varying parameters, such as a resource maximum demand, represented by one or more predetermined thresholds.

In the following description of the disclosure and embodiments, reference is made to the accompanying drawings, in which are shown, by way of illustration, specific embodiments that can be practiced. It is to be understood that other embodiments and examples can be practiced, and changes can be made without departing from the scope of the disclosure.

In addition, it is also to be understood that the singular forms "a," "an," and "the" used in the following description are intended to include the plural forms as well, unless the context clearly indicates otherwise. It is also to be understood that the term "and/or" as used herein refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units but do not preclude the presence or addition of one or more other features, integers, steps, operations, elements, components, units, and/or groups thereof.

Some portions of the detailed description that follows are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that, throughout the description, discussions utilizing terms such as "processing," "computing," "calculating," "determining," "displaying," or the like, refer to the action and processes of a computer system, or similar electronic computing device, that manipulates and transforms data represented as physical (electronic) quantities within the computer system memories or registers or other such information storage, transmission, or display devices.

Certain aspects of the present invention include process steps and instructions described herein in the form of an algorithm. It should be noted that the process steps and instructions of the present invention could be embodied in software, firmware, or hardware and, when embodied in software, could be downloaded to reside on and be operated from different platforms used by a variety of operating systems.

The present invention also relates to a device for performing the operations herein. This device may be specially constructed for the required purposes, or it may comprise a general-purpose computer selectively activated or reconfigured by a computer program stored in the computer. Such a computer program may be stored in a non-transitory, computer-readable storage medium, such as, but not limited to, any type of disk, including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The methods, devices, and systems described herein are not inherently related to any particular computer or other apparatus. Various general-purpose systems may also be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein.

Throughout the disclosure, reference is often made to use of the systems and methods or aspects of the systems and methods described herein for flight departure rerouting, for example, from airports with shared airspace. However, reference to flight departures is for illustration purposes only and is not meant to be limiting. Embodiments of systems and methods described herein can be used for any system, group of systems, installation, group of installations, facility, group of facilities, etc., in which there is a need for resource departure rerouting over fixed resources. For example, systems and methods can be used for rerouting of trucks from a shipping facility or other location or group of locations, rerouting of goods through a factory or other facility or group of facilities, and/or rerouting of any other asset through a limited set of defined resources.

Systems and methods according to some embodiments can be particularly useful in cases where multiple airports are in close proximity and share the same airspace, since these areas generally experience the highest congestion. In these cases, departure traffic may be managed by a central controller that provides centralized management for departures from the all the airports within its purview. This central control is often called a Terminal Radar Approach Control (TRACON). FIG. 1 illustrates an exemplary multi-airport shared airspace (metroplex) that may be managed by a TRACON. FIG. 1 highlights the operational use of embodiments of systems and methods described herein.

Metroplex 100 includes two airports (102 and 104) that share airspace 106 and predefined airspace resources—departure routes and departure fixes. A given flight path may be defined by multiple waypoints through which the flight passes en route to its destination. Departure fixes (108, 110, 112) are generally the first waypoint on the flight path. For example, departure fixes 110 and 112 may be the first waypoints on one or more flight paths that also include waypoint 120 and the second waypoint. Multiple departure fixes may be available for flights departing airports 102 and 104. Due to the proximity of the airports in metroplex 100, one or more departure fixes are shared by the airports, meaning that a flight departing from either airport may be routed to the shared departure fix. Departure routes are the predefined paths that aircraft take from the airports to the departure fixes. Each route leads to a specific departure fix. For example, route 114 leads from airport 102 to departure fix 108. A departure fix may be connected to an airport by a single departure route or by multiple departure routes. For example, departure fix 112 is connected to airport 102 by only route 126, whereas departure fix 108 is connected to airport 102 by routes 114 and 116.

The use of departure fixes may be constrained to a predetermined maximum number of flights within a period of time to reduce congestion. A set of departures is generally planned such that a given departure route or departure fix is not overly congested.

During a disruption in the departure airspace, such as from a weather event, one or more departure fixes and/or departure routes may experience some further restriction on its normal capacity. For example, a strong bank of thunderstorms may require a given departure fix to be shut down for the period of time that the storm is in the area of the departure fix. Planned flight departures that would put the flight at the departure fix when it is shut down have to be rerouted or delayed.

Flight departures may be rerouted in a number of ways. A flight may be rerouted to a different departure route for the same departure fix. For example, route 114 may be shut down due to weather in the area, and a flight planned to depart from airport 102 on route 114 may be rerouted onto route 116, which leads to the same departure fix 108. A flight may be rerouted to a different departure fix. For example, if departure fix 112 is shut down due to convective weather, a flight planned to depart on route 126 to fix 112 may be rerouted to route 124, which also leads to fix 110. Since, both fix 112 and fix 110 are on flight paths that lead to waypoint 120, the flight can continue on its planned flight path.

With metroplex operations, the ability to reroute multiple flights based on disruptions affecting multiple routes/fixes and yet maintain on-time departures is a daunting task. To effectively reroute flights, a TMC must know which routes are available, how those routes impact other departure fixes and routes, the additional flying time required to fly those routes, etc. In addition, TMCs must quickly coordinate the selected reroutes with multiple control facilities, as well as with flight operators. The greater the scale of the operational situation, the less a TMC's ability to manage the situation while meeting the operational priorities, which often leads to delays. According to some embodiments, the systems and methods described herein can provide optimized solutions for rerouting in complex operational situations of any scale and can do so automatically, continuously, and in real time.

System for Departure Rerouting

Systems for automatic and continuous optimization of departure routing are described below. The systems can automatically and continuously generate optimized departure routing for complex and changing operational situations. The systems can generate models of departure operational situations and determine departure rerouting based on configurations of departure resources (departure routes and fixes), departure routing constraints (such as fix capacities), and the departure routing operational priorities (such as on-time departures).

Figure 2:
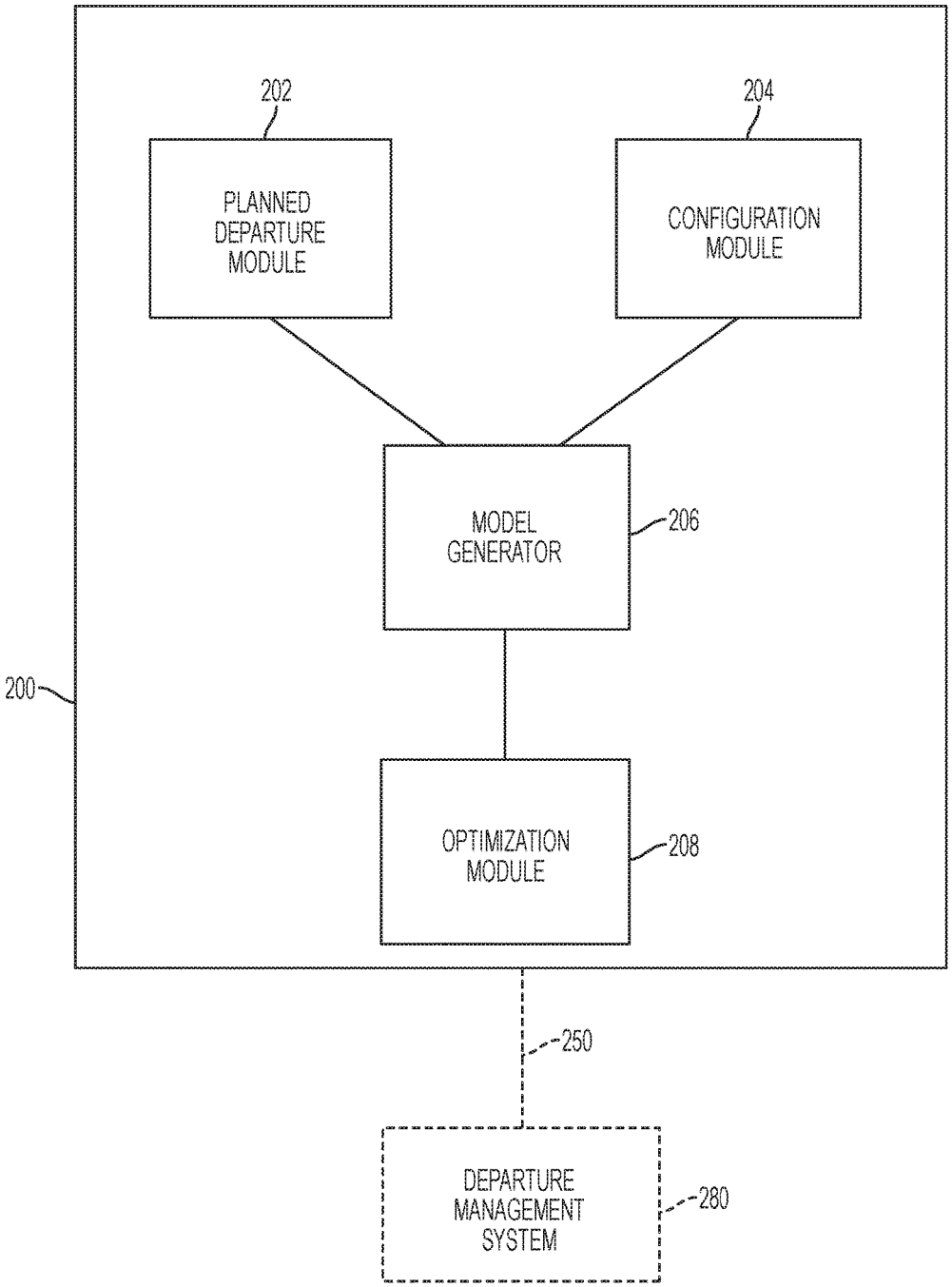
FIG. 2 illustrates a system for departure rerouting, according to some embodiments.

FIG. 2 is a functional block diagram illustrating system 200 for automatic departure routing, according to some embodiments. According to some embodiments, system 200 is connected via communication network 250 to one or more departure management systems 280. Departure management systems 280 may include one or more systems for managing departures and managing departure resources. Departure management systems 280 may include systems for planning, storing, and/or updating information associated with departures including departure times and departure routes for planned departures and/or departing assets that remain in the departure area. In some embodiments, for example, the information may include or be based on flight plans. Departure management systems 280 may include one or more user interfaces for enabling an operator to create, modify, update, or otherwise change the information associated with departures. Departure management systems 280 may include systems for determining, storing, and/or updating aspects of the departure resources. This may include storing the departure area resource configuration and/or predicting how events such as weather events may impact the departure area resources. Departure management systems 280 may include one or more user interfaces for enabling an operator to create, modify, update, or otherwise change departure resource related information.

In some embodiments, departure management systems 280 may transmit information to system 200, via communication network 250, based on the information associated with departures. For example, departure management systems 280 may transmit a set of planned departures for which optimized rerouting is desired. In some embodiments, departure management systems 280 transmits one or more changes to one or more departure resources to system 200. System 200 may respond to receiving information from departure management systems 280 by updating a departure routing model and generating an updated departure routing solution. System 200 may transmit one or more reroutes to departure management systems 280, which may, in turn, update departure management information such that departing assets are routing based on reroutes determined by system 200. System 200 may initiate receipt of information from departure management systems 280 (e.g., via one or more requests) and departure management systems 280 may push updates to system 200.

System 200 includes departure module 202, configuration module 204, model generator 206, and optimization module 208. Departure module 202 manages information about planned departures for which system 200 determines departure routing solutions. Configuration module 204 manages the configuration of and constraints on departure resources used by departures. Model generator 206 generates a departure model based on the planned departure information and the departure resource configuration and constraints. Optimization module 208 generates optimized departure solutions based on the models generated by model generator 206. System 200 can continuously and automatically generate departure models and optimized departure solutions to provide continuous departure routing and rerouting solutions for changing operational situations.

Departure module 202 manages information about planned departures from one or more departure locations. Generally, system 200 optimizes the departure routing of the planned departures associated with the planned departure information managed by departure module 202. According to some embodiments, information about planned departures that is stored by departure module 202 includes a departure name, a departing location, and departure time or departure time window, and a planned departure route. For example, in embodiments used for flight departure routing, the planned departure information may include, for each flight departure, the name of the flight, the planned departure time, and the planned departure route.

Departure module 202 may store planned departure information received from one or more departure management systems, such as, for example, one or more Flight Data Processing Systems that may be part of system 200 or may be separate from system 200 but in communication with system 200. Departure module 202 may update the planned departure information based on changes to planned departures (e.g., changes to planned departure times, routes, etc.), removals of planned departures, and/or additions of planned departures.

The planned departures for which information is managed by departure module 202 may be determined in various ways. Planned departures may be selected by an operator making a selection via system 200 or some other system in communication with system 200, and the information about the selected planned departures may be transmitted to departure module 202. For example, an operator may select departures for a departure area affected by weather and/or congestion and/or departures for a departure area that can be used for rerouting of the departures in the congested area. The information for the selected departures may be received and stored by departure module 202. The information may augment information already managed by departure module 202 (i.e., information for other departures previously selected) or may replace previously stored information.

In some embodiments, information about planned departures may be automatically and continuously updated in response to operational changes. For example, departure module 202 may store information about all departures planned for a given time period (e.g., for the succeeding hour, succeeding several hours, entire day, etc.) and may automatically and continuously receive information about changes to planned departures, such as removal of planned departures that have departed, addition of planned departures, changes to departure times and/or routes, etc. Departure module 202 may be in continuous communication with one or more departure management systems (e.g., flight departure management systems) to maintain up-to-date information about planned departures. In some embodiments, one or more entries for planned departures stored by departure flight module 210 may be updated based on reroutes generated by system 200. For example, system 200 may generate a reroute for a given flight that results in updating the corresponding departure information stored in departure module 202.

According to some embodiments, planned departure information stored by departure module 202 includes information about alternative routes and/or fixes. The alternative routes and fixes associated with a given departure are those that can be used to arrive at the destination. For example, for flight departure embodiments of system 200, multiple fixes may lead to the same en route airspace, and, thus, any of the multiple fixes may be used by a flight headed to the en route airspace. The planned departure information for the flight can include a planned departure fix and one or more of the other fixes that connect to the same en route airspace. An example of this is seen in FIG. 1, in which both fix 110 and fix 112 can be used to get to waypoint 120 and then on to the remaining route. Similarly, a planned departure for a given flight may include alternative routes that may be used to get to the planned (or alternative) fix. For example, as shown in FIG. 1, a flight with a planned departure route 114 to get to fix 108 could use alternate departure route 116 to get to the same fix 108.

Additional information for departures may be stored by departure module 202, according to some embodiments. Examples of additional information may include whether a departure has already been rerouted and/or how many times it has been rerouted and how long a departure is delayed from its original planned departure time. In some embodiments, additional information may include the relative importance of a departure compared to other departures. For example, the information may reflect that a departure with more passengers takes priority over a departure with fewer passengers, a passenger departure takes priority over a cargo departure, etc. Any other information that can be used to determine an departure routing solution may be included.

Configuration module 204 manages information about the configuration of and constraints on departure resources used by departures. Configuration information generally includes information about predetermined associations between departure resources. The information may include a list of the departure fixes in the departure area (e.g., TRACON airspace), a list of the departure routes to reach the departure fixes, and the associations between the routes and the fixes. For example, information may include, for each route in the departure area, a route start point (e.g., airport) and the fix that the route leads to. As the configuration of the departure area changes over time (e.g., new fixes are added/removed), configuration module 212 can store the latest configuration. Configuration module 204 may communicate with one or more systems that maintain configuration information, or the configuration information may be configurable within system 200 itself.

In addition to maintaining information about the available resources and their interrelationships, configuration module 204 can maintain information about constraints on usage of the resources. Constraints on resources can include limits on the usage of the resource in a given period of time (i.e., capacities). For example, a given fix may have a predetermined limit on the number of departures passing through the fix in a set period of time. This limit may be set by operators to limit the congestion in the area of the fix. There may be multiple constraints for a single resource. For example, a resource may be assigned a default capacity limit that is meant to be effective during normal operating conditions and may be assigned a lower limit during a weather event. In some embodiments, a constraint may be represented by a single value that may be changed based on the operational situation (for example, reduced from a default level to a lower level based on a weather event).

Configuration module 204 may communicate with one or more systems to receive constraints on resources or to update constraints on resources. In some embodiments, system 200 includes functionality for setting and adjusting constraints, for example, based on user input or based on automatic response to weather conditions.

Model generator 206 generates a model of the departure resources and demand on the departure resources based on the configuration, constraint, and usage information managed by configuration module 204 and departure module 202. In some embodiments, model generator 206 generates a directed graph model. In some embodiments, the directed graph model may be based on a network flow formulation of the departure problem. The model can capture the relationships among the planned departures, the departure resources, the resource configurations and constraints, and operational priorities and enables solution generation with minimal computational effort.

Figure 3:
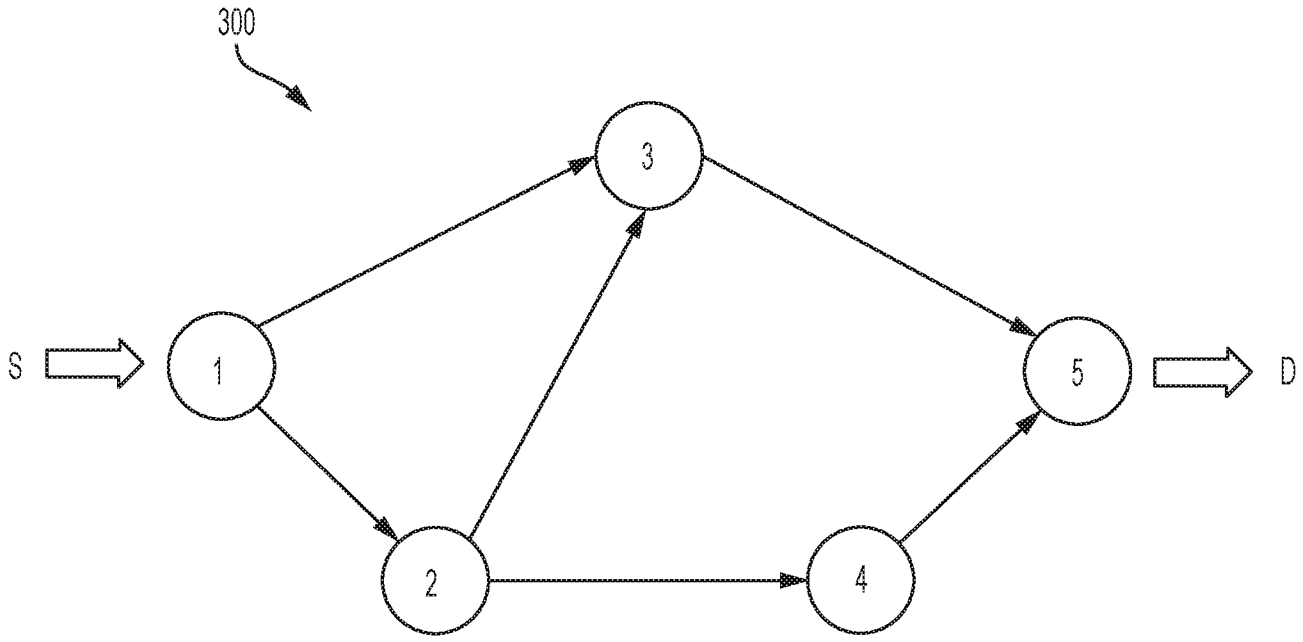
FIG. 3 illustrates a simple directed graph illustrating principles of the model generation by the system of FIG. 2, according to some embodiments.

Generally, a network flow formulation can be conceptually represented as a directed graph, such as a flow network, that is defined by nodes and arcs (also referred to herein as connections), such as the network 300 shown in FIG. 3. According to some embodiments, the network flow formulation uses a directed network that contains arcs that specify the directional connectivity between two nodes. For example, network 300 includes five nodes ($N=\{1, 2, 3, 4, 5\}$) and 6 arcs ($A=\{a_{12}, a_{13}, a_{23}, a_{24}, a_{35}, a_{45}\}$), where N defines the set of nodes and A defines the set of arcs. The notation $a_{ij}$ describes the arc from node i to node j.

Two of the nodes in network 300 have special characteristics. Node 1 is defined as a source node, because it has no incoming arcs (connections from other nodes) but does have incoming supply (S). Similarly, node 5 is defined as sink node because it has no outgoing arcs (to other nodes) but does have outgoing demand. In network flow problems, the total supply into the network must equal the total demand out of the network.

The general goal of a network flow problem is to define how the supply S transits the network from the source to the sink. The amount of flow on an arc is defined as $x_{ij} \geq 0$ $\forall a_{ij} \in A$. The amount of flow on a given arc $a_{ij}$ can be limited by an upper bound or capacity constraint $U_{ij} \geq 0$. A cost-per-unit flow $C_{ij} \geq 0$ can be assigned to each arc as well. Thus, the goal is to minimize the total cost of transiting from the supply to the demand—i.e., from node 1 to node 5, subject to satisfying the capacity constraints on the arcs. The resulting values of $x_{ij}$ describe the movement of flow in the network. Model generator 206 can generate a network flow model of a departure situation that includes planned departures and departure resources (routes and fixes) modeled as nodes with the planned departures modeled as source nodes. The constraints and capacities associated with departure resources can be modeled by assigning various factors, multipliers, costs, etc., to the connections between the nodes.

Once the departure model has been generated by model generator 206, optimization module 208 determines an optimized set of flows through the departure model by minimizing the total cost of transiting the model from the supply to the demand.

According to some embodiments, the departure problem solved by system 200 has constraints and costs that can be time-varying. This time-varying behavior may be captured by employing a time-expanded network formulation, such as described in J. J. Jarvis and H. D. Ratliff's, "Some Equivalent Objectives for Dynamic Flow Problems," *Manage. Sci.*, vol. 28, no. 1, pp. 106-109, January 1982, which is incorporated herein by reference in its entirety. According to some embodiments, the time expanded network generally replicates a static network formulation at discrete time points. Using this approach, the arcs in the network can also be used to represent transit time through the network. As such, some embodiments can represent delay prior to departure and/or transit time to different routes or fixes.

FIGS. 4A-4D illustrate the operation of system 200 in a simple planned departure rerouting scenario, according to some embodiments. This scenario is highly simplified for the purposes of illustrating basic features of system 200. Real-world operational scenarios in which system 200 can be utilized will generally be significantly more complex than the scenario depicted in FIGS. 4A-4D.

Figures 4A, 4B:
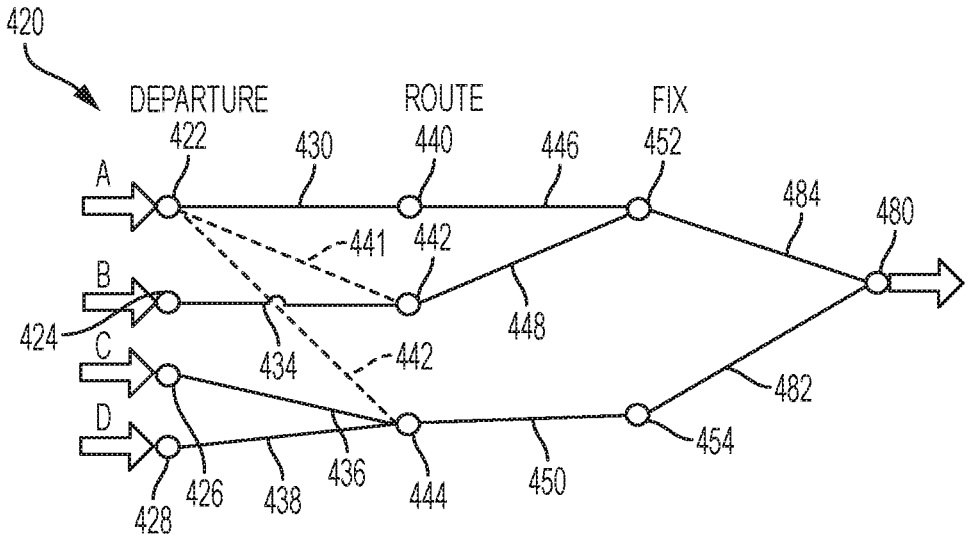
FIG. 4A illustrates an exemplary table of planned departures, according to some embodiments.
FIG. 4B illustrates an exemplary network graph based on the table of FIG. 4A, according to some embodiments.

FIG. 4A illustrates a table of planned flight departures (table 402) that may be managed by departure module 202. Table 402 includes four planned flights (A, B, C, and D) that, for the purposes of illustration, are schedule to depart within the same window of time. Each flight includes a planned route. The planned routes lead from the departure points to a departure fix. As explained above, the departure fix is the first waypoint in a series of waypoints that the flight will reach en route to its destination location. In table 402, the departure routes are named Alpha, Beta, and Gamma. As shown, flight A is planned to depart on departure route Alpha, flight B is planned to depart on departure route Beta, and flights C and D are planned to departure on departure route Gamma. The entry for flight A further includes alternate routes Beta and Gamma illustrating that flight A could be rerouted to either of these routes and still be able to continue on to its destination. Alternate routes are not shown for the remaining flights for the purpose of simplification.

FIG. 4B illustrates model 420 that may be generated by model generator 206 based on the planned departure information of table 402 maintained by departure module 202 and based on departure resource configuration information (not shown) maintained by configuration module 204. Model 420 includes a node for each planned departure. Thus, node 422 is associated with flight A, node 424 is associated with flight B, node 426 is associated with flight C, and node 428 is associated with flight D. Model 420 includes a node for each departure route. Thus, node 440 is associated with departure route Alpha, node 442 is associated with departure route Beta, and node 444 is associated with departure route Gamma. Model 420 further includes nodes for the fixes associated with the routes. These fix nodes may be included in the model based on the configuration data managed by configuration module 204. Two fix nodes are included in model 420—fix node 452 and fix node 454.

Model 420 includes connections between the nodes. These connections are included in the model based on the planned flight information and based on the departure resource configuration information. The connections between each flight node and each departure route node indicate that the flight can be routed on the connected routes. For example, flight A can be routed on planned route Alpha, as indicated in the second column of table 410, or on alternative routes Beta and Gamma, as indicated in the third column of table 410. Thus, connections 430, 431, and 432 are made between flight A node 422 and route nodes 440, 442, and 444, respectively. Connections 431 and 432 to nodes 442 and 444, respectively, are shown with dashed lines to illustrate that they are alternative routes.

Connections 446, 448, and 450 are made between the route nodes and the fix nodes based on the configuration of the departure resources. As shown, route nodes 440 and 442 (corresponding to routes Alpha and Beta) are connected to fix node 452, which corresponds to the departure fix that both routes Alpha and Beta lead to.

A solution to model 420 includes a flow from each departure node (source node) through one of the fix nodes and to the demand node 480. For example, the combination of connections 430, 446, and 484 is a path for node 422, the combination of connections 434, 448, and 484 is a path for node 424, and so on. A first solution to model 420 is the planned departure shown by the solid-line connections between nodes (the planned departure scenario). A second solution is provided by using the route associated with node 442 as an alternative route for flight A, which is represented in the model by connection 431. A third solution is provided by using route 444 as an alternative route for flight A, which is represented in the model by connection 432. The second and third solutions represent reroute options for the set of planned departures.

Model 420 can include one or more constraints on the flows through the model. An example of a constraint is a limit on the amount of flow through a given node. For example, a fix may be limited by the air traffic control authority to two flights passing through the fix in a given time period. Thus, the flow through the associated fix node is constrained to be no greater than two. A constraint may vary, for example, based on an event such as severe weather. As a result of the event, the flow through a fix may be constrained to be no greater than a given value or even zero.

Figures 4C, 4D:
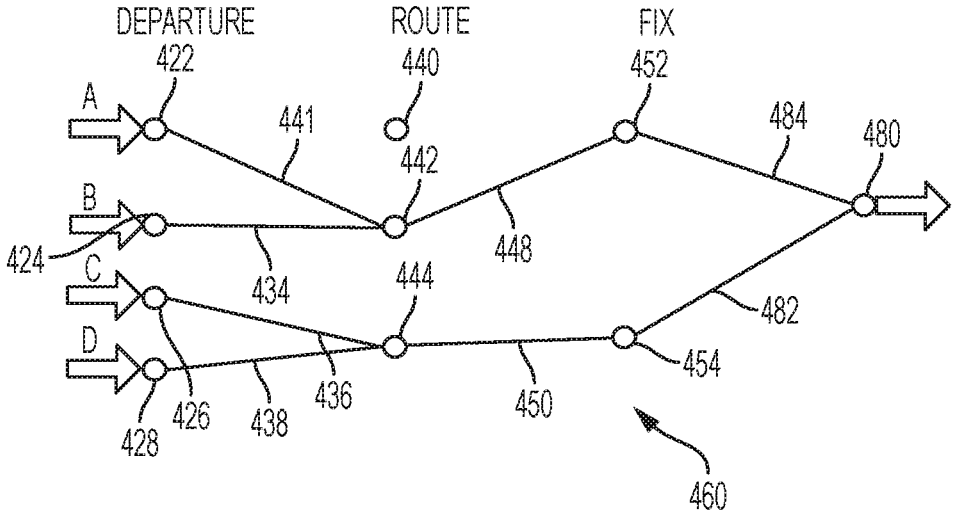
FIG. 4C illustrates a solution to the network graph of FIG. 4B, according to some embodiments.
FIG. 4D illustrates an exemplary table of departures based on the solution of FIG. 4C, according to some embodiments.

The presence of constraints can reduce the number of solutions to the model. For example, applying a fixed constraint of no more than two departures through a fix associated with fix node 454 and an event-based constraint of no use to the departure route associated with node 440 reduces the number of possible flows through model 420 to a single flow. This solution is shown in FIG. 4C. In this scenario, flight A had to be rerouted from its planned departure route Alpha based on the closure of departure route Alpha due to severe weather. As shown by connections 431 and 432 of model 420, flight A could potentially be rerouted to departure route Beta or Gamma. However, rerouting of flight A to departure route Gamma would result in three departures through the departure fix represented by fix node 454, which would violate the fixed constraint of no more than two departures through a fix node. Thus, the solution based on the planned flights, departure resource configuration, and constraints is the one shown in FIG. 4C in which flight A is rerouted to route Beta. This solution is shown in table 470, in which the route for planned flight A has been changed from Alpha to Beta.

In a realistic scenario with many more variables than in the above scenario, there may be multiple possible solutions. By incorporating metrics and priorities into the model, embodiments of system 200 can determine an optimized solution out of many possible solutions. Metrics are predetermined criteria by which solutions are evaluated. Metrics are associated with operational characteristics, such the presence of weather blockage, coordination time between installations/personnel/etc., extra travel time, or any other aspect that can affect the choice of routing for departures. Priorities define how important different criteria are relative to one another. Metrics and priorities may be used to determine a solution for example, for an operational scenario in which a metric is defined as the number of reroutes. A first solution that includes two reroutes may be preferred over a second solution that includes three reroutes. Where more than one metric is defined, weights may be assigned to the metrics to balance the relative importance of the operational characteristics associated with the metrics. For example, reducing the congestion of a fix may be more important than reducing the number of reroutes per flight, in which case, the weights assigned to the former would be greater than the weights assigned to the latter.

According to some embodiments, metrics are incorporated into the model via one or more factors assigned to a given connection in the network. A factor assigned to a given connection is used as a multiplier on the flow through that connection. A solution that includes more flow through a connection with a multiplier will have a higher total value than a solution that has less flow through the connection (all else being equal).

Optimization module 208 generates a set of departures based on the model generated by model generator 206. According to some embodiments, optimization module 208 determines flows through a directed network model using one or more directed network optimization algorithms. Optimization module 208 searches for a solution that minimizes the total cost of transiting the supply (for example, from node 1 to node 5 in FIG. 3 and from nodes 422, 424, 426, and 428 to demand node 480 in FIG. 4), subject to satisfying the capacity constraints on the arcs. The resulting values of $x_{ij}$ describe the movement of flow in the network. In some embodiments, the output of optimization module 208 includes the departure routes for the planned departures. Other outputs may include the demand on various departure resources reflected in the computed flow through the arc or node representing the resource.

The scenario illustrated in FIGS. 4A-4B represents a given time period. A solution for model 420 may hold until one or more variables change over time. The most obvious change is that the flights used to build the model have departed, and the departures of new flights are to be included in the model. Other changes may include changes in weather, changes in operational priorities, etc. System 200 can continuously and automatically provide solutions in response to a change in the operational situation by rebuilding and re-solving the model.

The above systems and methods were described in general terms to illustrate the extensibility of embodiments of system 200 to any departure routing problem that includes defined departure resources, constraints, and demands. Described below are systems and methods for flight departure routing that may be used by metroplex operations to reroute flights in response to changing operational scenarios.

Method for Flight Departure Rerouting in a Metroplex

Described below are methods, according to some embodiments, for departure rerouting in a metroplex. The methods may be performed by one or more systems according to embodiments described herein, such as system 200 of FIG. 2. The methods may be used for any scale of metroplex operations and can find rerouting solutions automatically and continuously in real time for complex operational situations involving a large number of time-varying variables (planned departures, constraints, configurations, metrics, priorities, etc.).

Figure 5:
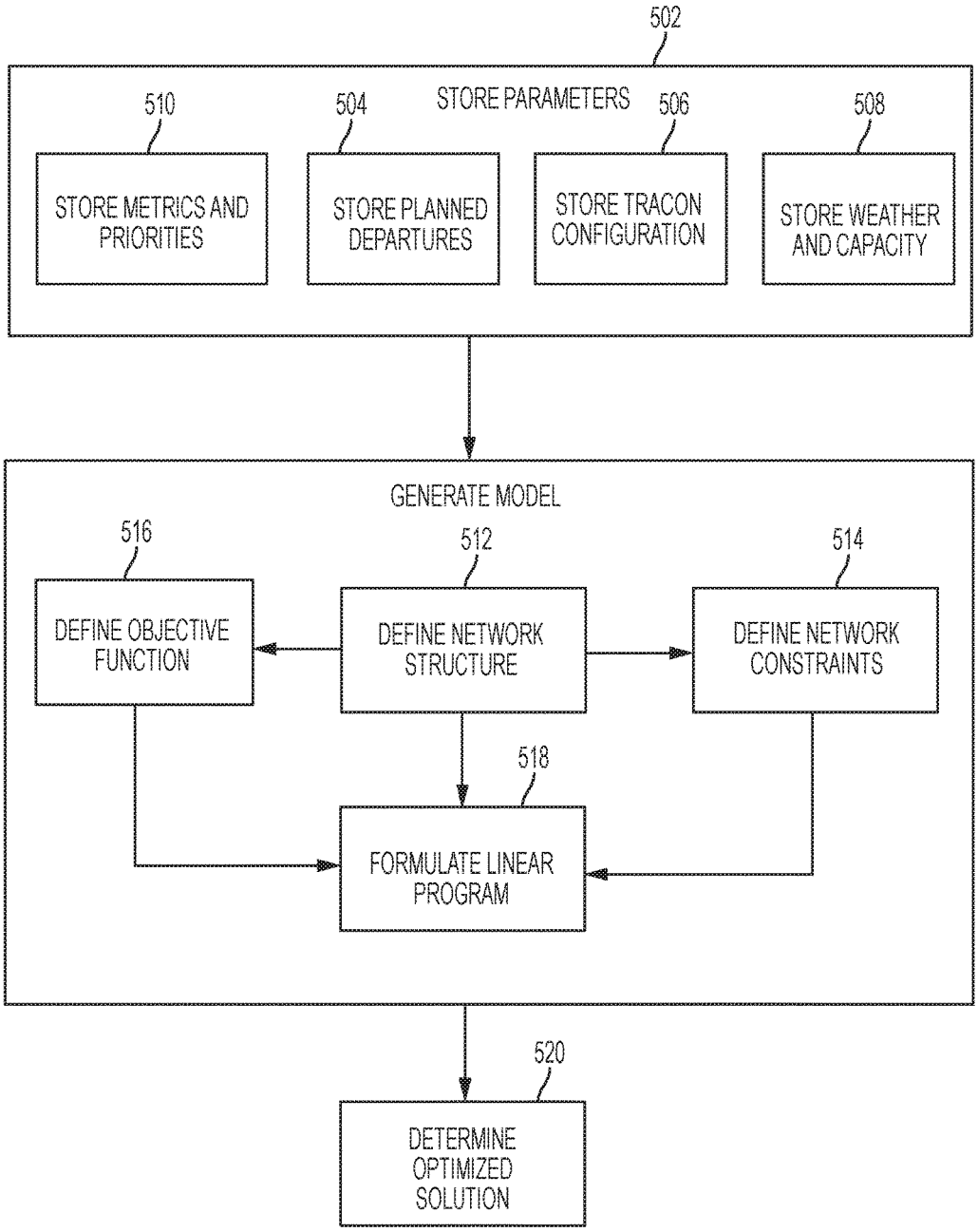
FIG. 5 illustrates a method for flight departure routing, according to some embodiments.

FIG. 5 is a flow diagram illustrating method 500 for automatic departure routing for a metroplex, according to some embodiments. At step 502, the various parameters defining the departure routing operational situation for which method 500 will determine an optimized solution are stored. This may include storing the planned departure flights in step 504, storing the TRACON configuration data in step 506, storing the capacities in step 508, and storing the metrics and priorities in step 510.

Storing the planned departure flights in step 504 can include storing information about planned departures from one or more departure locations. Generally, method 500 optimizes the departure routing of the planned departures associated with the planned departure information stored in step 504. According to some embodiments, information about planned departures that is stored in step 504 includes the information in Table 1, below, for each planned departure that is to be included in the departure rerouting solution.

TABLE 1

| Parameter Name | Parameter Description |
|---|---|
| Departure Airport | The departure airport for each flight |
| Current Route | The current departure route of the flight |
| Departure Time | The flight's current departure time |
| Route Options | A list of alternative departure route options available for each flight |
| Previous Reroute | A flag that notes if the flight has previously experienced a reroute |

The above table is exemplary only and is not intended to be limiting. Any other information that may be specific to a flight may be included in the information stored in step 504.

Storing TRACON configuration data in step 506 may include storing information about predetermined departure routes and departure fixes in the air space controlled by the TRACON of a metroplex, including connectivity information and constraint information. Table 2 below lists the information that may be stored in step 506, according to some embodiments.

TABLE 2

| Data Item | Data Description |
|---|---|
| Departure Fix Name | Name of the departure fix |
| Departure Route Name | Name of departure route |
| Fix - Route Connectivity | List of departure routes associated with each departure fix |
| Resource Availability | The resource availability [primary (p), secondary (s), or neither (n)]associated with each departure fix. |

The first two parameters specify the resource names (or other identifiers) which are used by the third data item to describe the network connectivity. The final data item, resource availability, further limits the flight route connectivity as defined below.

According to some embodiments, in order to capture realistic alternatives for flights, method 500 distinguishes departure routes and/or fixes by three categories of availability.

Primary: Flights can be removed from a primary fix, but no additional flights may be added to it.

Secondary: Flights can be removed from or added to a secondary fix.

Neither: Flights cannot be removed from this resource but can be added to it.

"Primary" fixes are those whose congestion method 500 is performed to resolve. The range of solutions that may be determined and optimized by method 500 can be expanded by allowing "secondary" fixes to be considered in the resolution. When secondary fix resolutions are allowed, method 500 can consider the benefit of moving additional flights off a non-congested (secondary) fix to accommodate additional flights from a congested (primary) fix. Adaptation rules regarding allowable reroutes between fixes may be encoded in method 500 to ensure that only feasible reroutes are permitted for any flight and that only flights with appropriate departure route options are considered by method 500. "Neither" requires any solution to keep the flight routed through the fix.

Storing the capacities in step 508 may include storing the capacities of the departure routes and fixes stored in step 506. Capacities can provide an upper limit to the flow on arcs in the network. The presence of weather provides additional constraint information that generally reduces the nominally defined capacity. These resources can vary over time, and capacities can be defined relative to a period of time. Table 3 below lists the data items and descriptions for this input, according to some embodiments.

TABLE 3

| Data Item | Data Description |
|---|---|
| Departure Route Capacity | The nominal capacity of a route may be infinite |
| Departure Fix Capacity | The nominal capacity of a fix in a 15-minute period |
| Departure Fix hourly Capacity | The nominal capacity of a fix for an hour-long period, which may be lower than the sum of four (4) nominal 15-minute period capacities |

As stated in Table 3, the nominal capacity of a route may be unconstrained. However, in cases where route blockage is predicted (for example, by a TRACON weather management system that is in communication with a system performing method 500, such as system 200 of FIG. 2), the capacity of a route with moderate blockage may, for example, be modeled as one flight per 15 minutes while severe blockage may, for example, be modeled as zero flights per 15 minutes. According to some embodiments, departure fixes can be the main resource constraint considered by method 500. According to some embodiments, departure fixes can be subject to both 15-minute thresholds and hour-long thresholds, either of which can be more restrictive. Other thresholds may be defined as well. As with routes, weather may reduce the capacity limits for one or more fixes. Thus, capacities may have predefined nominal values but may change over time in response to events. According to some embodiments, capacities may be increased, which can provide additional solution options. For example, there may be no solution for a given set of constraints in which each flight is assigned to a departure, and, in response, one or more constraints may be relaxed in order to find a solution. In some embodiments, a system performing method 500 may automatically modify one or more constraints, and, in other embodiments, a user may modify one or more constraints.

Storing metrics and priorities in step 510 can include storing the evaluation criteria by which solutions to the departure scheduling problem are evaluated in method 500 in order to determine the optimized solution. The metrics may be assigned to different arcs in the network and are proportional to the unit flow on the arc. Table 4 provides an exemplary list of metrics that may be used according to some embodiments.

TABLE 4

| Metric Name | Metric Description |
|---|---|
| Deferred Decision | Defines a cost for not identifying a suitable departure option for a flight that meets the identified constraints. This situation can occur if demand is in excess of capacity or too few available options are provided for each flight. |
| Weather Blockage | Defines a cost for assigning a departure route to a flight that is designated as weather-blocked. This cost is imposed on the route for all flights and is time varying. |
| Coordination Time | Defines a cost for assigning a departure route to a flight that requires additional coordination to implement. This is assigned to the flight and route option combination and therefore can vary between flights and options. |
| Extra Flying Time | Defines a cost for assigning a route option for a flight that incurs extra flying time. As each route option for a flight has a specified flying time, including the original route option, this cost is |

TABLE 4-continued

| Metric Name | Metric Description |
|---|---|
| | pre-calculated for each route option and flight. Note that an assignment that results in reduced flying time is not rewarded (i.e., negative costs are set to zero) |
| Operational Preference | Defines a cost for assigning a flight to each of the available route options provided. |
| Previous Reroute | Defines a cost for each flight that is assigned a route option other than the current option if the flight has previously incurred a reroute. |
| Route Change | Defines a cost for each flight that is assigned a route option other than the current option. This is in addition to the previous cost. |

Once the parameters defining the flight departure operational situation are set, method 500 proceeds with modeling the flight departure routing problem. This includes defining the network structure at step 512, modeling the network constraints at step 514, defining the objective function at step 516, and formulating the linear programming problem at step 518. After these steps are performed, solutions can be computed, and an optimized solution can be determined in step 520, as described further below.

Step 512 includes defining the network structure. Since the operational situation of a metroplex varies with time (e.g., flights depart, weather comes and goes, etc.), the first step to defining the network structure in step 512 may be to define the time discretization for a time-expanded network. For example, in some embodiments, capacity constraints may be listed in 15-minute time intervals. Thus, starting at the top of the hour, four time bins per hour may be defined, each consisting of 15 minutes. This is exemplary only, and one of skill in the art will understand that any other interval may be used.

After the time bins have been defined, the nodes of the network are defined. For each planned flight departure, a planned flight departure node is defined and designated as a source node in the network. The input supply to each of these flight nodes is one. The flight's planned departure time determines to which time bin of the network the flight will be assigned. The flight's departure time bin specifies the time network that the flight will be evaluated in, which impacts the feasibility of the allocation, given the capacity constraints. According to some embodiments, flights may be connected to later departure routes, in which case, the cost of departure delay can be captured. According to some embodiments, flights are grouped by departure airport (for convenience) and/or ordered by departure time (for convenience).

The TRACON configuration stored in step 506 defines the routes and fixes for the problem. For each route listed, a node may be created and replicated at each time bin. The flight nodes are connected to the fix nodes as follows. The route options listed for each flight define which route nodes a given flight node can connect to. According to some embodiments, connections are only made between nodes in the same time bin. Similarly, the route nodes may be connected to the fix nodes in the same time period, as defined by the route-fix connectivity parameter described above with respect to Table 2, which specifies which routes are associated with a given fix. Only routes associated with the specified fix have connections in the network.

According to some embodiments, after the connections are made based on the TRACON data, connections may be removed based on constraints. Resource availability may require removal of some of the defined connections between flights and routes. For example, fixes and associated routes can be constrained by defining the three categories of availability discussed above—primary, secondary, and neither. As stated above, flights can be removed from a primary fix, but no additional flights may be added to it; flights can be removed from or added to a secondary fix; and flights cannot be removed from a fix with a neither constraint but can be added to it.

These rules are captured in the network connectivity between flights and routes as follows. First, all routes associated with a fix are defined to have the same availability as defined for the fix. This is without loss of generality as routes are associated with only one fix. For primary fixes/routes, only flights currently assigned to the route/fix can continue have a connection to that route in the network, and no flights with different current routes can be connected, regardless of whether the route is listed as a viable route option for the flight. In some embodiments, these constraints are static, and, in other embodiments, these constraints are time varying, for example, in line with the network discretization.

"Neither" fixes/routes limit the connectivity of flights in an opposite manner. For any flight with a current route that is categorized as "neither," the only allowable outgoing connection from the flight node is to the planned route node. Essentially, the option set for these flights cannot be evaluated as alternatives in the solution. But flights currently assigned to primary or secondary fixes/routes can have outgoing connections to "neither" fixes/routes, indicating possible reroute options for those flights. Secondary fixes/routes do not limit the current connectivity defined between the flight nodes and the route nodes listed in the flight's route options.

One of the capacity parameters describes a constraint on hourly fix capacity, which may include predetermined nominal values and may include transient values, such as based on a weather event. In order to capture this constraint, another set of nodes may be defined—denoted as fix-hour nodes for illustration. According to some embodiments, fix-hour nodes are connected only to the same named fixes with time periods within the specified hour.

Two other nodes and connections are added to complete the network structure. First, a demand node is defined, and each fix-hour node is connected to the demand node. The demand node has no outgoing connections but does have outgoing supply, equivalent to the total number of flights, thus ensuring that the network input equals the network output.

The second node added to the network, denoted as a defer node, captures the need to consider situations where not all flights can be assigned to a departure route given the current constraints. Each flight node is connected to the defer node, which is then connected to the demand node, again preserving input to output equality.

After defining the network structure in step 512, the network constraints are added to the model in step 514.

According to some embodiments, the network constraints are defined by the weather and capacity inputs and may include three parameters: route capacity, fix capacity, and fix-hourly capacity. These capacities are assigned to the arcs in the network as follows. Route capacity is defined for each route during each time bin. Therefore, a given route capacity is transformed into an upper limit on arc flow between the given route node and its fix node. Similarly, the fix capacity is translated into an upper bound on the flow out of the fix node into the fix-hour node. Finally, the fix-hour capacity is translated into an upper bound on the flow between the fix-hour node and the demand node.

In step 516, the objective function is defined based on the network structure and constraints as formulated in steps 512 and 514 and on the metrics stored in step 510. As described above, in some embodiments, metrics and priorities may be stored that include seven cost parameters: deferred decision, weather blockage, coordination time, extra flying time, operational preference, previous route, and route change. The first metric, deferred decision, is assigned to the arc connecting each flight node with the defer node. The remaining six cost parameters are applied to the arcs connecting the flight nodes with different route options. Pre-defined weights can be used to assess the relative priorities between these different metrics.

Figure 6:
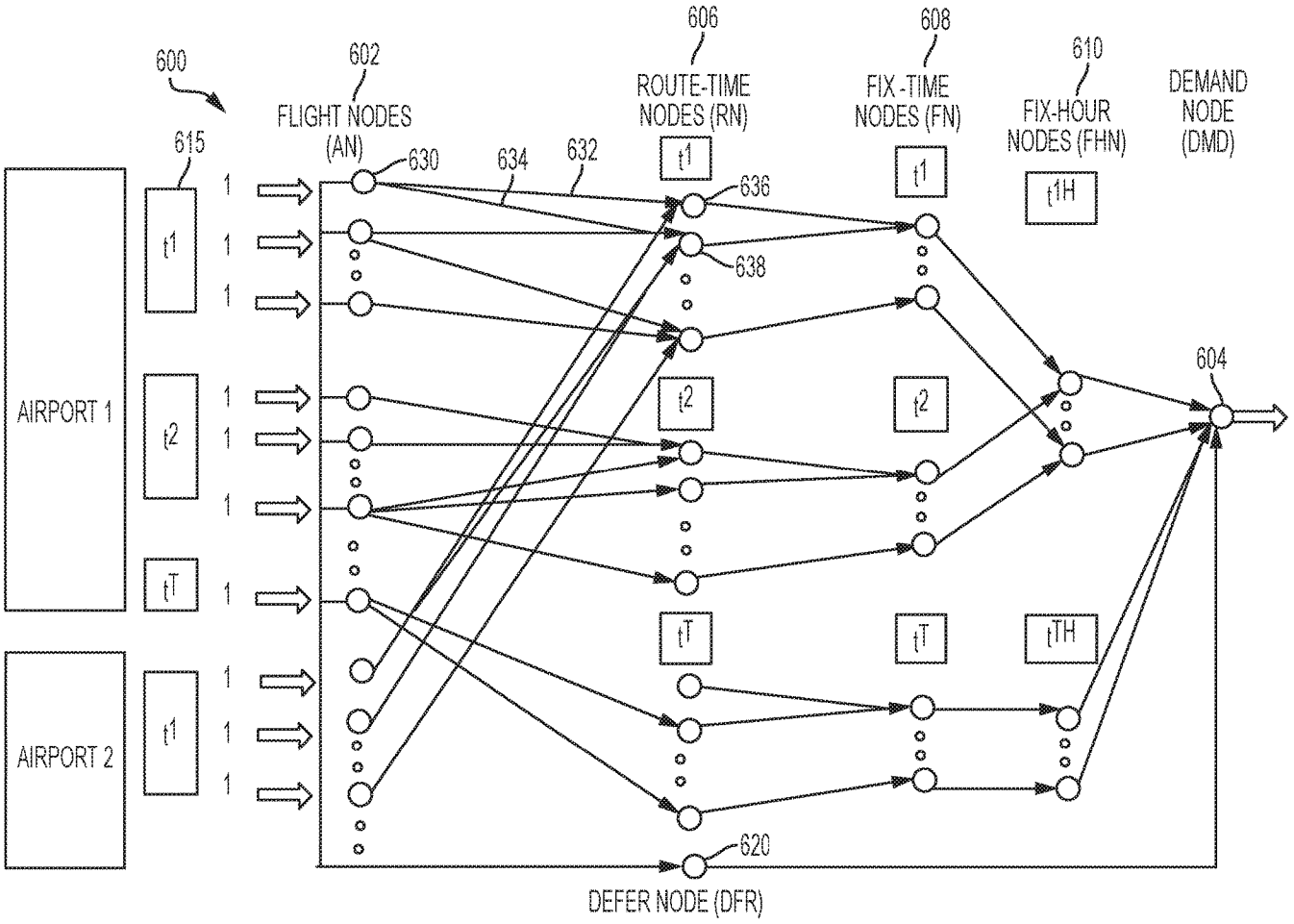
FIG. 6 illustrates a multi-airport, time-expanded network graph, according to some embodiments.

A network that may be formulated according to the above steps is illustrated in FIG. 6. As described above, nodes represent the network resources, and the arcs define the viable pathways between the nodes. Flow enters network 600 at the flight nodes (602), travelling through various arcs before exiting the network at the demand node (604). The specific arcs utilized define the selection of the route and fix for each flight. Defer node 620 is provided to enable a solution to be found when the model is over-constrained (i.e., no solution is possible that assigns each of the departures to a departure route).

A mathematical formulation of the network structure generated in steps 512-516, according to some embodiments, is described below, with reference to network 600 of FIG. 6. As explained above, the first step in network formulation is to define the time discretization employed in the time-expanded network. Specifically, the time period of interest is defined as beginning at time $T_0$ and lasting until time T. By defining a constant time step ΔT, the number of time periods or time bins K can be computed as follows, where the brackets denote that non-integer results are rounded up to the next larger integer.

$$K = \left\lceil \frac{T - T_0}{\Delta T} \right\rceil \qquad \text{Equation 1}$$

For $k=\{1, 2, \ldots K\}$, $t^k$ is defined as the beginning of the $k^{th}$ time bin where $t^1=T_0$ and $t^K=T_0+\Delta T*(K-1)$.

The set of flight nodes 602 that represent individual flights is defined as belonging to the subset of nodes AN, where AN(i) is the $i^{th}$ AN node. For every node $i \in AN$, the following properties of the node are defined:

$p_i$: The airport associated with the $i^{th}$ AN node $r_i$: The current route of the $i^{th}$ AN node $t_i$: The departure time bin requested by the $i^{th}$ AN node $a_i$: The resource availability [primary (p), secondary (s), or neither (n)] associated with the current route of the $i^{th}$ AN node $O_i$: The option set $\{o_i^1, o_i^2, \ldots o_i^{L_i}\}$ associated with the $i^{th}$ AN node, where:

$o_i^k$: The $k^{th}$ alternate departure route option available for flight i $L_i$: The number of flight options available for flight i Each route option represents a unique route, and the time for the route option is the same as the departure time bin for the flight, namely $t_i$. The current route is included in the option set.

The second set of nodes (606) defined in FIG. 6 is the set of available routes, defined by both the route and a departure time bin, which are denoted as belonging to the set RN, where RN(i) is the $i^{th}$ RN node. For every node $i \in RN$, the following properties of the node are defined:

$r_i$: The departure route associated with the $i^{th}$ RN node $t_i$: The departure time bin associated with the $i^{th}$ RN node $a_i$: The resource availability [primary (p), secondary (s), or neither (n)] associated with the route for the $i^{th}$ RN node In some embodiments, the arcs defined between the AN nodes and RN nodes exist in the set of arcs, A, under the following conditions:

$$(i, j) \in A \text{ iff} \begin{cases} i \in AN,\ j \in RN \\ t_i = t_j \\ r_j \in O_i \\ \text{if } a_i = n \text{ then } r_i = r_j \\ \text{if } a_j = p \text{ then } r_j = r_i \end{cases} \qquad \text{Equation 2}$$

As reflected in Equation 2, in this embodiment, a flight node can only be connected to a route node when it is in the same time bin and when the route node is part of the option set provided by the flight. For example, in network 600, flight node 630 is connected (via arcs 632 and 634) only to route nodes (nodes 636 and 638) in its same time bin 615. The final two conditions state additional constraints on which connections are permitted. First, when the current route of the flight has an availability designation of "neither," the flight cannot be rerouted, and, therefore, the connection is only permitted when the route is the current route of the flight. Second, when the route has an availability of "primary," this implies that no flights may be rerouted onto it, and, therefore, the connection is only permitted when the current route of the flight is this same route.

The third set of nodes (608) defined in FIG. 6 represents the available fixes, where only route nodes that are associated with a given fix are connected to the given fix, and the connection is in the same departure time bin. The fix-time nodes are defined as being in the subset of nodes FN, where FN(i) is the $i^{th}$ FN node. For every node $i \in FN$, the following properties of the node are defined:

$f_i$: The fix associated with the $i^{th}$ FN node $t_i$: The time associated with the $i^{th}$ FN node $R_i$: The set of departure routes $\{r_i^1, r_i^2, \ldots r_i^{M_i}\}$ associated with the $i^{th}$ FN node where:

$r_i^m$: The $m^{th}$ departure route associated with the $i^{th}$ FN node $M_i$: The number of routes associated with fix i In some embodiments, the arcs defined between the RN nodes and FN nodes exist in the set of arcs, A, under the following conditions:

$$(i, j) \in A \text{ if} \begin{cases} i \in RN,\ j \in FN \\ r_i \in R_j \\ t_i = t_j \end{cases} \qquad \text{Equation 3}$$

The conditions for existence defined in Equation 3 simply state that a connection between a route node and a fix node can only exist when the route is connected to the fix and that the nodes share the same departure time bin.

The fourth set of nodes (610) defined in FIG. 6 represents the corresponding hourly bins, where each of the four corresponding fix nodes in the hour connect to the associated fix-hour node. Each fix-hour node is defined as belonging to the subset of nodes FHN, where FHN(i) is the $i^{th}$ FHN node. For every node∈FHN, the following properties of the node are defined:

$fh_i$: The fix associated with the $i^{th}$ FHN node $th_i$: The departure time hourly bin associated with the $i^{th}$ FHN node In some embodiments, the arcs defined between the FN nodes and FHN nodes exist in the set of arcs, A, under the following conditions.

$$(i, j) \in A \text{ if} \begin{cases} i \in FN,\ j \in FHN \\ f_i \in fh_j \\ th_j \le t_i < th_{j+1} \end{cases} \quad \text{Equation 4}$$

At the bottom of FIG. 6 is the defer node DFR (620). For every node in AN, there exists a connection to DFR node 620. Any flow on arcs to the DFR node 620 represent flights that do not have a feasible route that satisfies the constraints. In some embodiments, these flights are kept on their original routes, and the problem has not been fully solved.

Finally, the node at the right side of FIG. 6 is the demand node DMD (604). There exists an arc in the network between every FHN node 610 and DMD node 604. There exists an arc from DFR node 620 to DMD node 604, as well. Capturing this final node allows for the network model to be complete, effectively providing an exit for all demand, just as the nodes in AN provide the entrance.

Constraints impose a restriction on the total network flow through a resource—the resource capacity—and are represented as upper bounds or limits on the associated network arc. These resource capacities can vary in time. According to some embodiments of FIG. 6, capacities on both routes and fixes are represented as 15-minute capacity constraints and are applied to all flights utilizing the resource. As stated above, the nominal capacity for routes may be infinite, but in cases where route blockage is predicted, the capacity of a route may be limited, for example, with moderate blockage modeled as one flight per 15 minutes and severe blockage modeled as zero flights per 15 minutes. Defining the capacity of route r in time bin t as $U_{r,t}$, the upper bound associated with the various arcs in A is defined as follows:

$$U_{i,j}=U_{r,t}\forall i\in RN, j\in FN \text{ such that } r_i=r, t_i=t \quad \text{Equation 5}$$

The 15-minute fix capacities are modeled in a similar fashion, where the capacity of fix f in time bin t is denoted as $U_{f,t}$. Using this definition, the upper bound associated with the various arcs in A is defined as follows:

$$U_{i,j}=U_{f,t}\forall i\in FN, j\in FHN \text{ such that } f_i=f, t_i=t \quad \text{Equation 6}$$

In addition to 15-minute time bin capacities, fix resources are subjected to hourly capacity constraints, which are applied on the outgoing arcs of the fix-hour nodes. Hourly fix capacities are modeled in a similar fashion, where the capacity of fix fh in time-hour bin th is denoted as $U_{fh,th}$. Using this definition, the upper bound associated with the various arcs in A is defined as follows:

$$U_{i,j}=U_{fh,th}\forall i\in FHN, j\in DMD \text{ such that } f_i=fh, t_i=th \quad \text{Equation 7}$$

Based on the above equations, the objective function defined in step 516 can be formulated as follows. To begin, any flow to the DFR node signals that the flight has not been assigned a route that satisfies the constraints. As this may be highly undesirable, a significant penalty (factor) may be assigned to any flow along arcs to the DFR node. Defining this cost as $C_f^U$ for each flight f (as the cost may be defined differently for each flight node in AN), the cost imposed on the corresponding arcs is as follows:

$$C_{i,j}^U=C_f^U\forall i\in AN, j\in DFR \text{ such that } f_i=f \quad \text{Equation 8}$$

To capture the weather blockage in the objective function component as opposed to (or in addition to) a capacity constraint, the cost component of the objective is defined as $C_{r,t}^W$ for each route r in time bin t. The cost imposed on the corresponding arcs is as follows:

$$C_{i,j}^W=C_{r,t}^W\forall i\in RN, j\in FN \text{ such that } r_i=r, t_i=t \quad \text{Equation 9}$$

Assuming the cost of coordination is flight- and option-specific, the cost of coordination is defined as $C_{f,r,t}^C$ for each flight f, route option r, and time bin t. The cost imposed on the corresponding set of arcs is as follows:

$$C_{i,j}^C=C_{f,r,t}^C\forall i\in AN, j\in RN \text{ such that } f_i=f, r_j=r, t_i=t \quad \text{Equation 10}$$

The excess flying time penalty is similarly defined as the cost of flying time $C_{f,r,t}^T$ for each flight f, route option r, and time bin t. The cost imposed on the corresponding set of arcs is as follows:

$$C_{i,j}^T=C_{f,r,t}^T\forall i\in AN, j\in RN \text{ such that } f_i=f, r_j=r, t_i=t \quad \text{Equation 11}$$

The operator acceptability penalty is similarly defined as $C_{f,r,t}^O$ for each flight f, route option r, and time bin t. The cost imposed on the corresponding set of arcs is as follows:

$$C_{i,j}^O=C_{f,r,t}^O\forall i\in AN, j\in RN \text{ such that } f_i=f, r_j=r, t_i=t \quad \text{Equation 12}$$

To impose a penalty associated with rerouting a flight that has already experienced a previous reroute, a parameter is added to the subset of flight nodes, AN. Specifically, for every node i∈AN, the following additional property of the node is defined:

$c_i$: The existence of a previous reroute where $c_i=1$ when a previous reroute has been made and $c_i=0$ when no previous reroute has been made With this additional information, the cost of modifying a flight with a previous reroute is defined as $C_{f,r,t}^R$ for each flight f, route option r, and time bin t. The cost imposed on the corresponding set of arcs is as follows:

$$C_{i,j}^R=C_{f,r,t}^R\forall i\in AN, j\in RN \text{ such that } (f_i=f, r_j=r, r\in O_i, r_i\neq r, c_i=1, t_i=t) \quad \text{Equation 13}$$

Finally, in order to discourage optimizing the routes for flights not involved in the congestion resolution process, a route change penalty is defined as $C_{f,r,t}^P$ for each flight f, route option r, and time bin t. This penalty is only applied to route options that do not correspond to the current route of the flight. The cost imposed on the corresponding set of arcs is as follows.

$$C_{i,j}^P=C_{f,r,t}^P\forall i\in AN, j\in RN \text{ such that } f_i=f, r_i\neq r, t_i\neq t \quad \text{Equation 14}$$

Having defined the existence of all arcs in the network, the departure routing problem can be formulated as a linear problem in step 518. In some embodiments, the linear problem can be formulated as the minimization of Equation 15, below, subject to the constraints of Equations 16-22, below.

$$\sum_{(i,j)\in A} (w_U C^U_{i,j} x_{i,j} + w_W C^W_{i,j} x_{i,j} + w_C C^C_{i,j} x_{i,j} + w_T C^T_{i,j} x_{i,j} + w_O C^O_{i,j} x_{i,j} + w_R C^R_{i,j} x_{i,j} + w_P C^P_{i,j} x_{i,j}) \quad \text{Equation 15}$$

Where $w_U$, $w_W$, $w_C$, $w_T$, $w_O$, $w_R$, and $w_P$ are the weights on the cost penalties for deferred flights, weather blockage, coordination, excess flying time, flight operator acceptability, previous reroute, and route change, respectively. The minimization may be subject to the following constraints, where $x_{i,j}$ represents the flow along the arc traveling from node i to node j.

$$\sum_{\{j:(i,j)\in A\}} x_{i,j} = 1 \quad \forall\, i \in AN \quad \text{Equation 16}$$

$$\sum_{\{j:(i,j)\in A\}} x_{i,j} - \sum_{\{j:(j,i)\in A\}} x_{j,i} = 0 \quad \forall\, i \in RN, FN, FHN, DFR \quad \text{Equation 17}$$

$$\sum_{\{j:(j,i)\in A\}} x_{j,i} = |AN| \quad \forall\, i \in DMD \quad \text{Equation 18}$$

$$0 \le x_{ij} \quad \forall\, i, j \in N \quad \text{Equation 19}$$

$$0 \le x_{i,j} \le U_{r,t} \quad \forall\, i \in RN,\ j \in FN \text{ such that } (i, j) \in A \quad \text{Equation 20}$$

$$0 \le x_{i,j} \le U_{f,t} \quad \forall\, i \in FN,\ j \in FHN \text{ such that } (i, j) \in A \quad \text{Equation 21}$$

$$0 \le x_{i,j} \le U_{fh,t} \quad \forall\, i \in FHN,\ j \in DMD \text{ such that } (i, j) \in A \quad \text{Equation 22}$$

Equations 16-18 are the network flow conservation constraints, which specify that all flow into a node must also leave the node. Specifically, Equation 16 states that the flow entering a flight node, which corresponds to a single flight, must exit using one of the available arcs. Equation 17 states that the flow into a node of the specified types must equal the flow out of that node. Equation 18 states that all the flow, equivalent to each flight and therefore quantified by the number of elements in the set AN, must equal the flow into DMD node 604. Equation 19 states that all flow must be non-negative. Equations 20-22 state that the flow on the specified arcs must satisfy the network capacity constraints.

Returning to method 500 of FIG. 5, the above formulation is solved in step 520. The results of the solution in step 520 can include the flow defined for each arc in the time-expanded network and the overall cost for the allocation. Since the supply into each the flight node is one unit, and the above network formulation preserves the integrality of the solution, only one outgoing arc from each flight node will be non-zero. In other words, nominally, one of the arcs connecting a flight to a route will have a value of one. The route connected to the arc having a value of one is the optimized route for that flight. The route may be the same as the originally planned route or may be different.

According to some embodiments, in some cases, no feasible alternative route may be identified for a given flight, and the flow for the given flight will travel along the arc leading to the defer node 620. In some embodiments, the flight may remain on its original route, and the congestion problem may be deemed unresolved. In response, one or more constraints, for example, as defined in step 502, may be changed in order to enable a solution to be found. In some embodiments, an operator may provide an input changing one or more constraints, and, in some embodiments, one or more constraints may be adjusted automatically. Generally, where a solution cannot be found, changes to the objective function weights may not provide a solution. Instead, the underlying network connectivity or the capacity constraints must be altered such that a new feasible option for the flight becomes available.

According to some embodiments, a linear or network optimization algorithm may be used to solve the above equations and to find an optimized solution. For example, the Simplex Method as described in Dimitris Bertsimas and John Tsitsiklis, Introduction to Linear Optimization, Athena Scientific, Belmont Mass., 1997, Chapter 3, is a straightforward and efficient algorithm for solving linear programs (LP). Although at worst, the Simplex Method solves an LP in exponential time (i.e., $o(\lambda^m)$, which means on the order of a constant ($\lambda$) to the number of constraints in the problem, m), in practice it generally converges in $o(m^\alpha)$ where $\alpha$ is a constant. Some embodiments may use Interior Point methods, which can also be used to solve LPs and efficiently converge in $o(n^\beta)$, where n is the number of variables and $\beta$ is a constant.

The Network Simplex Algorithm is a specific version of the Simplex Method that may be used. The Network Simplex Algorithm is tailored to the structure of a network. In a network, there exists a flow conservation constraint for every node and potentially a capacity constraint for every arc, such that the number of constraints m=|N|+|A|. The number of variables in the network are equal to the number of arcs in the network, such that n=|A|. The Network Simplex Algorithm can solve the problem in O(|N||A|log|N-|log |NC|, where C is the maximum cost value in the network.

In comparison, a general MILP requires exponential time to solve, with the worst case being full enumeration of the feasible solutions. In practice, a number of algorithms are often used, in combination, to identify an optimal or near-optimal solution. However, although many software packages have been developed to efficiently drive this process, the computation effort is highly dependent on the scale and structure of the problem and cannot be guaranteed.

Methods such as method 500, above, can be performed automatically and continuously to provide optimized rerouting solutions as the operational situation for the departure area (e.g., TRACON airspace) changes. In some embodiments, a user may initiate the finding of an optimized solution according to the methods and systems herein, for example, by interacting with a user interface used to set/select parameters. In other embodiments, systems and methods may be employed in an automated fashion, such that a departure model is automatically created (recreated) when some variable changes. As mentioned above, changes to variables such as planned departures, constraints, configurations, metrics, etc., can be automatically updated in some embodiments, for example, via communication with one or more external systems. Once a change is received, the system may automatically recreate or modify the departure model and find an updated optimized solution. In some embodiments, the system may automatically update the departure model and regenerate a solution based on preset timing. This timing may be based on the departure time bins. For example, the system may perform the model regeneration and optimization at intervals tied to the timing of the departure time bins. Any other scheduling may be used. In some embodiments, optimized departure rerouting solutions may be generated real time such that a rerouting solution is generated in response to an operational change within the amount of time needed to reroute the flights included in the rerouting solution. For example, optimized departure rerouting solutions may be generated for 100 flights departing from 3 airports, using 30 fixes over an hour, with both 15-minute and 1-hour constraints in less than 10 seconds. In some embodiments, optimized departure rerouting solutions may be generated for this scale of a problem in less than 1 minute, in less than 20 second, or in less than 1 second.

The section below describes the functionality of systems and methods according to some embodiments through three operational examples. In the first example, a system such as system 200 of FIG. 2 is utilized to solve a multi-flight, single-fix congestion problem. Two cases are developed in this example: the first only allows reroutes off of the congested fix, while the second allows "secondary" reroutes, which enables the system to consider solutions that move flights off of non-congested fixes to accommodate flights from the congested fixes. The results of these two cases are compared to highlight how certain operational choices affect the reroutes identified by the system.

The second example considers the resolution of a multi-fix scenario using a combined-fix feature that may be incorporated into a system, according to some embodiments. This feature can treat two fixes as a single fix such that the system can resolve the overall congestion by moving flights from a combined fix to alternate fixes. Such functionality may be desirable in high-congestion situations, potentially caused by severe weather, where the overall capacity of both fixes becomes coupled.

The third operational example demonstrates how changing priorities incorporated in the model according to embodiments (for example, through objective function weights) modifies the solutions. Results generated are compared to the first operational example.

EXAMPLE 1

Resolving Fix Congestion

In example 1, the system is utilized to solve a multi-flight, single-fix congestion problem. For this example, it is assumed that operational circumstances have resulted in projected congestion for the departure fix LANNA. The fix demand information for fixes in this example is shown in table 700 of FIG. 7A. The first column 704 lists departure fixes. The next four columns provide the demand in each of four 15-minute time bins. The sixth column 708 lists the demand for the hour spanned by the 15-minute time bins. The demands in each cell represent the number of flights in the time bin. For example, row 702 represents the demand for departure fix LANNA. Cell 712 is the demand—nine flights—for fix LANNA in the 11:45 p.m. time bin. This means that nine flights are currently planned to pass through the LANNA fix between 11:45 p.m. and 12:00 a.m. Cells are highlighted to show that the demand for the associated fix-time is at or over the predetermined threshold. For example, cell 712 is highlighted to show that the demand is over the predetermined threshold of five flights per 15 minutes. This is the case in three of the four 15-minute time bin. Cell 710 shows the demand for the entire hour spanning 11:45 p.m. to 1:45 a.m. The highlighting of cell 710 indicates that the hourly demand on fix LANNA exceeds the predetermined threshold of 18 flights per hour. As noted above, the hourly demand threshold on a fix may be less than or greater than the sum of the 15-minute demands.

A system, according to some embodiments, can solve congestion in a single 15-minute time period and/or for the entire hour. This example shows the latter. In a first case, the system is used to identify flights currently planned for LANNA that may be rerouting to alternate fixes such that the objective function is minimized, as described above. Table 5, below, lists some of the metrics defined above that are contained in the objective function of this example, along with their associated weights.

TABLE 5

| Metric | Symbol | Weight |
|---|---|---|
| Defer Node Utilization | $w_U$ | 100,000 |
| Weather Blockage | $w_W$ | 5 |
| Coordination | $w_C$ | 0 |
| Extra Flying Time | $w_T$ | 1 |
| Operational Preference | $w_O$ | 1 |
| Previous Reroute | $w_R$ | 3 |
| Route Change | $w_P$ | 2 |

The weight assigned to the first metric, the defer node utilization, can be arbitrary but is generally a very large number that makes solutions that use arcs connected to the defer node very costly relative to those that do not. This discourages rerouting options that lack assignments of departures to routes.

According to some embodiments, the hour-long LANNA fix congestion may be automatically identified and solved. In other embodiments, a user (such as a TMC) may select the hour-long LANNA fix to solve through, for example, one or more user interfaces. In some embodiments, in response to the user's selection, the user may be able to configure one or more parameters that can define the set of solutions and can shape the optimization. For example, a user interface may enable the TMC to specify a number of options, such as modifying the time period in which to resolve the problem, choosing additional fixes to resolve the problem, allowing reroutes from other fixes, adding filters to limit the solution, and adjusting the fix alert thresholds to reflect resource capacities. In some embodiments, once the TMC has set the desired options, the problem is evaluated and a solution is returned. In other embodiments, the parameters shaping the solutions may be predefined and built into the system such that the system can identify one or more congested resources and find rerouting solutions without requiring user input.

Figure 7A:
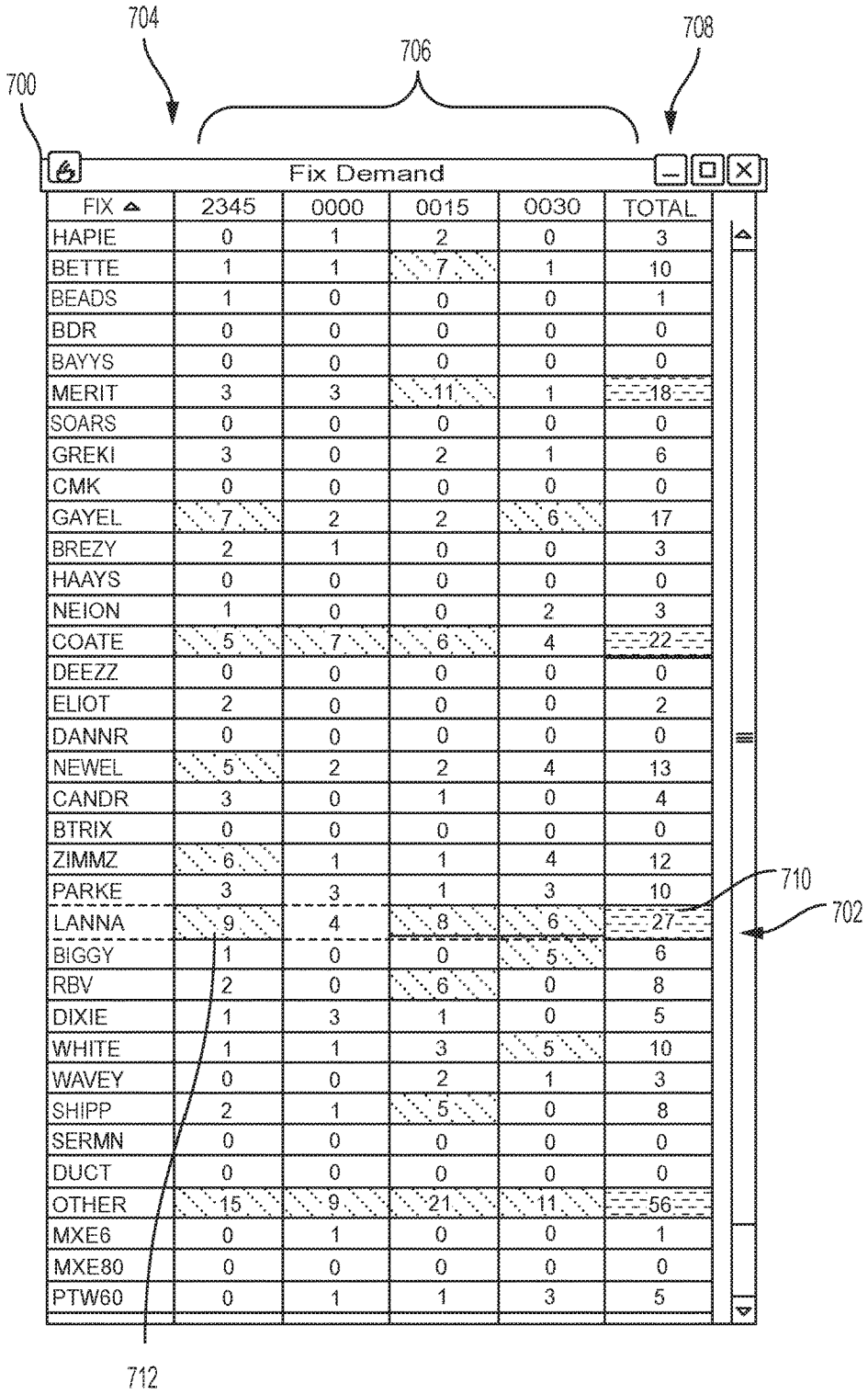
FIG. 7A illustrates a fix demand count table showing 15-minute and hourly flight demands for different fixes, according to one embodiment.
Figure 7B:
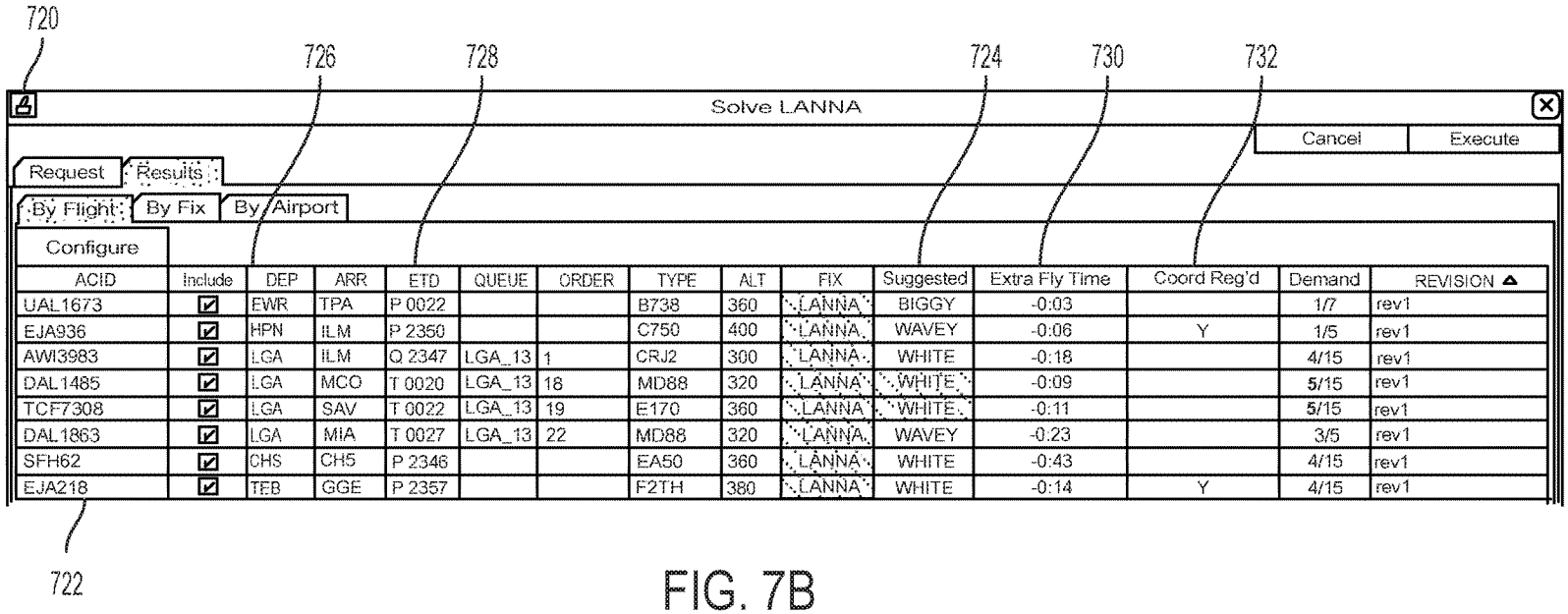
FIG. 7B illustrates alternate departure routes for flights on the departure fix LANNA of FIG. 7A generated for a first exemplary rerouting scenario.

FIG. 7B shows an exemplary user interface that may be generated by a system, according to one embodiment, that provides table 720 showing an optimized solution generated by the system—the identified flights (column 722) and the alternative departure fixes for those flights (column 724). In this example, eight flights were identified as having available alternatives that satisfy the capacity constraints and that provide an optimized rerouting solution. Five flights may be rerouted over WHITE, two over WAVEY, and one over BIGGY, as indicated by the entries in column 724. Additional information may also be provided, according to some embodiments. For example, departure airport (column 726), estimated departure time (column 728), extra flying time (column 730), and whether coordination is required (column 732) are provided in the table. This information may be provided for consideration by a TMC when evaluating the proposed solution.

Figure 7C:
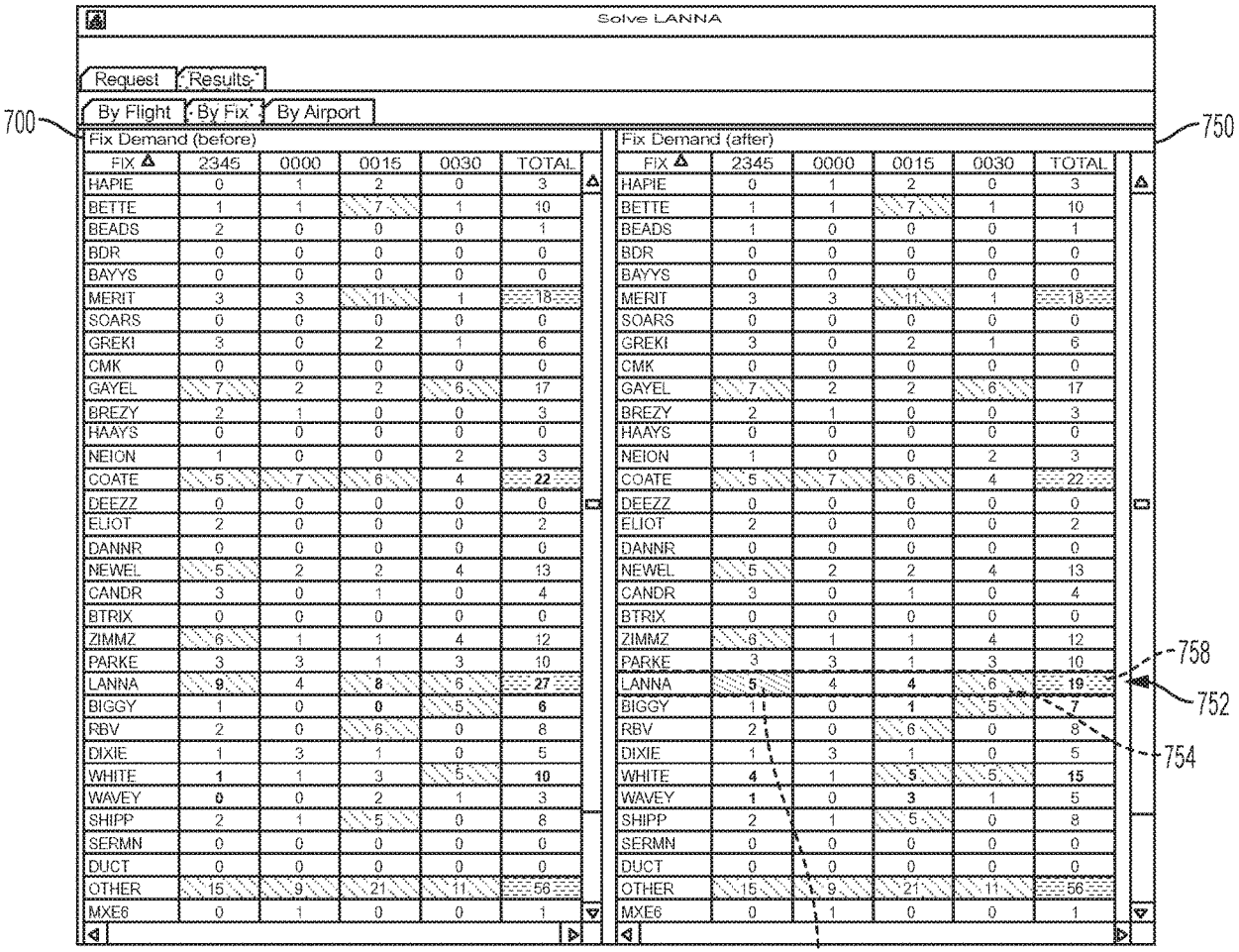
FIG. 7C illustrates the before and after fix demand count tables for the LANNA fix congestion alternate routes of FIG. 7B.

FIG. 7C shows the original fix demand table of FIG. 7A (700) side-by-side with an alternate fix demand table (750) that is based on the solution generated by the system. The changes in the demand are indicated by bold numbers in the tables. As seen in row 752, LANNA remains over capacity in two of the 15-minute time bins (cells 754 and 756) and over capacity for the hour overall (cell 758). This exemplifies that unresolved congestion can be a function of the operational constraints imposed on the model—for example, the availability of alternate departure options for flights on LANNA and the requirement that flights over other fixes not be rerouted.

In the second case of this first example, this latter constraint is relaxed such that flights on other fixes can be moved to alternate fixes to accommodate flights from LANNA. Doing so in this example increases the set of options available to the system, enabling it to identify a minimal cost solution that satisfies the congestion on LANNA. FIG. 7D shows the results of the optimization performed by the system when the secondary fix option is available. Ten flights are identified by the system for reroutes. Row 772 shows that a flight on departure fix WHITE, which is not congested, has been rerouted to fix WAVEY. As this reroute is in the last time bin, additional capacity is available to reroute a flight onto WHITE and achieve demand at or below each 15-minute alert threshold as well as the hourly alert threshold on LANNA. As shown in row 782 of FIG. 7E, each of the 15-minute and hourly demands for LANNA are at or below the respective thresholds (5 in cell 784 and 18 in cell 786).

EXAMPLE 2

Resolving Congestion with Fix Merging

In the operational environment, a situation may arise when an area of airspace is congested, and it may be necessary to limit the total demand across multiple fixes. According to some embodiments, the system may model this scenario by defining a new network model in which the planned demand on the combined fix is the total demand destined to the original (un-combined) fixes, and the nominal capacity threshold on the combined fix is the same as any other fix (for example, 5 flights in 15 minutes and 18 flights in an hour).

Figure 8A:
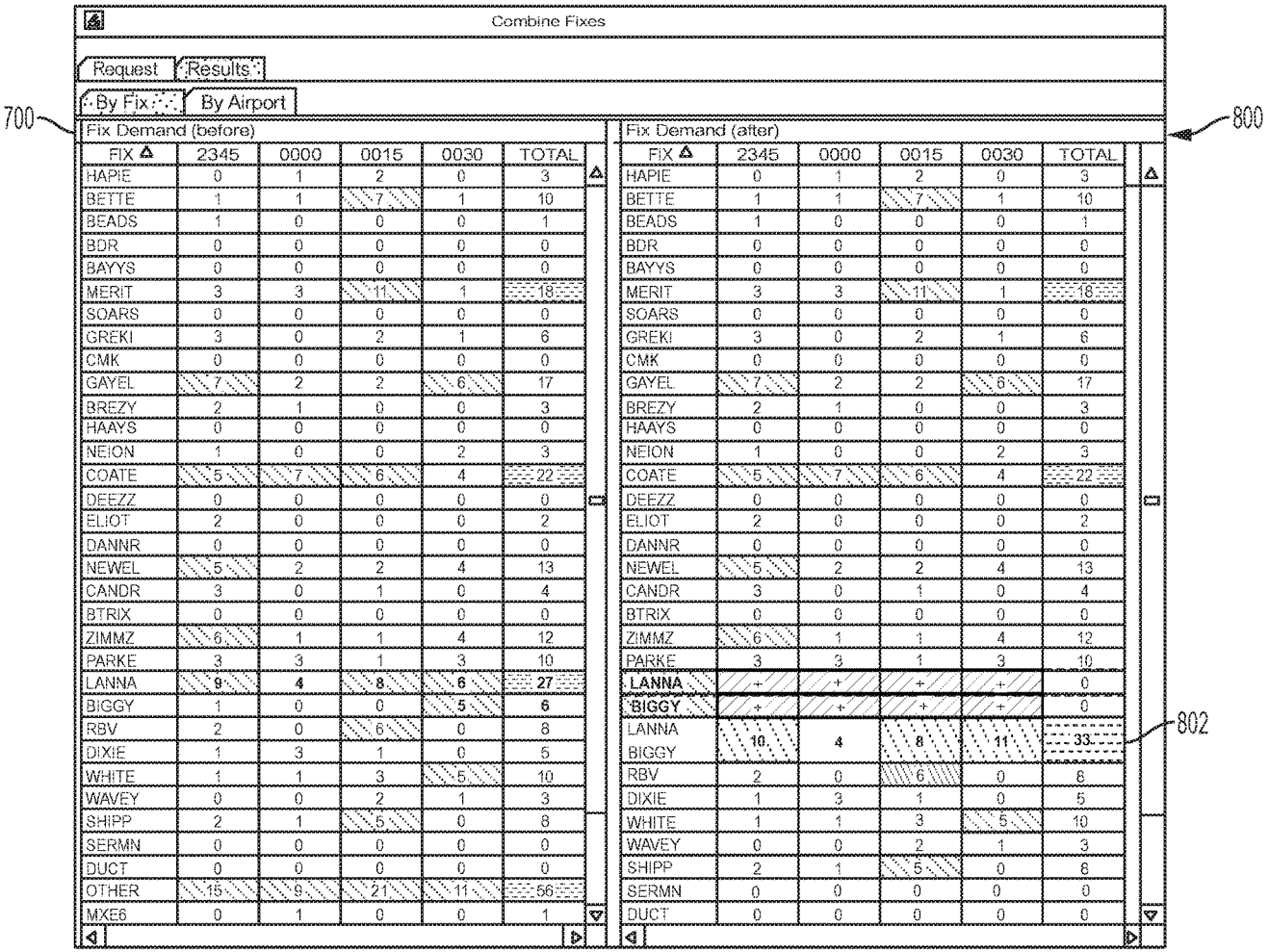
FIG. 8A illustrates a fix demand count table showing combined LANNA and BIGGY fix demands according to a second operational example.

In the previous example, part of the congestion resolution strategy for LANNA was to reroute a flight onto BIGGY. Referring back to FIG. 7A, fix BIGGY is shown as having little demand, whereas LANNA is already congested. Combining these two fixes will create a highly congested combined fix. FIG. 8A displays fix demand count table 700 side by side with fix demand count table 800, which has LANNA and BIGGY treated as a combined fix. As seen in row 802 outlined in blue in FIG. 8A, neither LANNA nor BIGGY alone are listed as having demand, but the total demand on both fixes for each time bin is defined for this new combined fix.

Figure 8C:
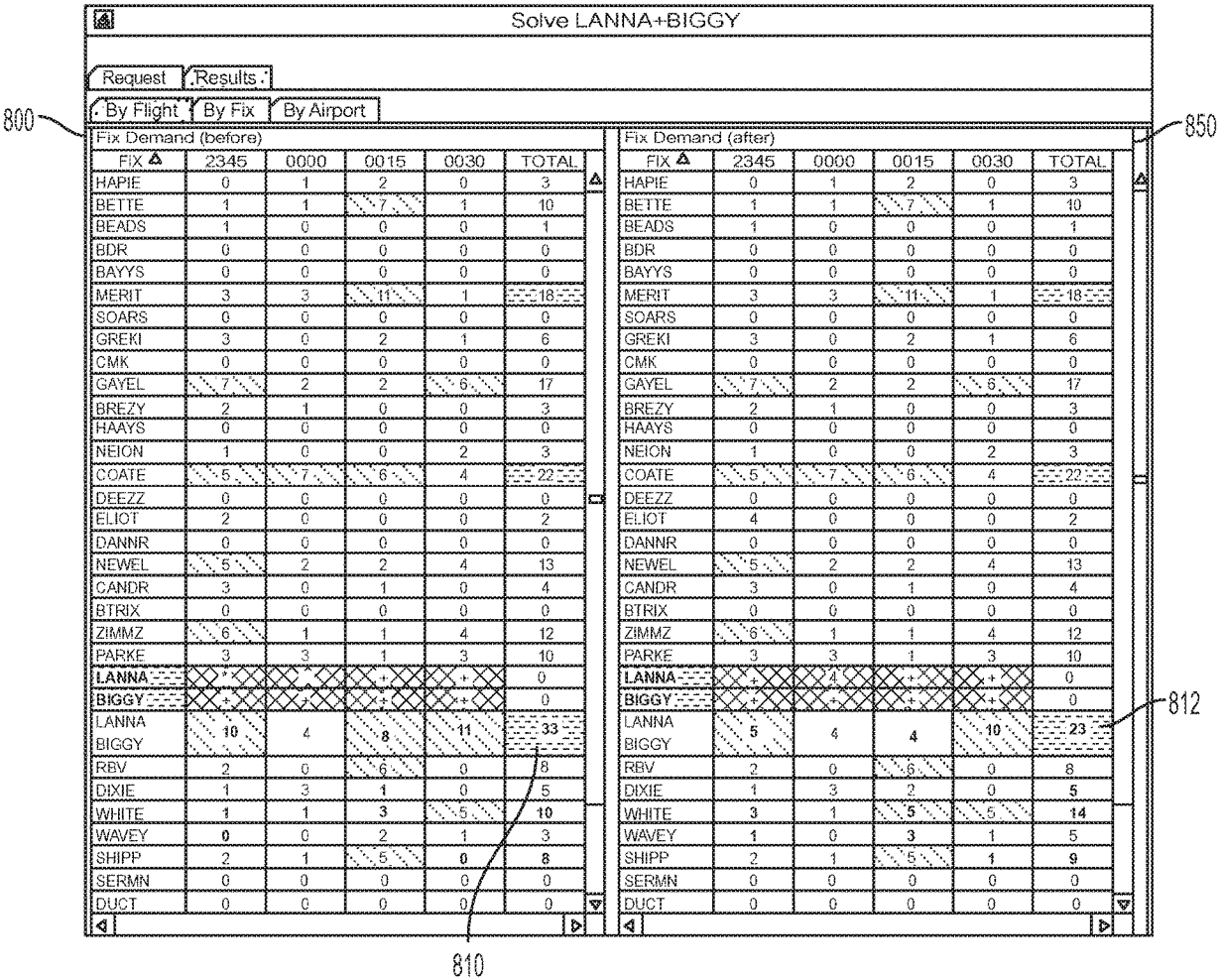
FIG. 8C illustrates the before and after fix demand count tables for the combined LANNA and BIGGY fix generated for the second example of FIG. 8A.

FIG. 8B shows the results of an optimization performed by the system. Ten flights are identified as having available reroutes, where six flights are rerouted over WHITE, two over WAVEY, and one each over PARKE and SHIPP. FIG. 8C shows the fix demand count tables for the original congestion (800) and resolved congestion (850), where the congestion on the combined LANNA+BIGGY fix is reduced from 33 for the hour (cell 810) to 23 for the hour (cell 812). Although the congestion remains unresolved, this lower level of congestion enables a TMC to focus on other flights and fixes.

EXAMPLE 3

Prioritizing Goals

According to some embodiments, the objective function metrics and their associated weights can represent the priority of multiple goals used in modeling a departure routing operational scenario. Because changing these weights can modify the optimized solution identified by the system, it may be desirable to tune the weights when adapting the system to the specific operating environment. Generally, a set of weights can be selected for on going use (for example, through trial and error or some other tuning process). The selected values may be strategically reconfigured based on changing operational priorities, for example, to accommodate seasonal shifts in traffic patterns.

In the third operational example, the impact of modifying weights in the objective—function, according to some embodiments, is illustrated. In table 5, above, the coordination cost was assigned a weight of zero, meaning that the system that uses the parameters of table 5 will effectively not consider coordination cost when evaluating the solutions. In the Example 3, the coordination cost is set to three while all other weights remain the same, so that the system will consider the coordination cost penalty to be three times more important, for example, than the extra flying time penalty and the operator preference penalty. This represents placing a higher priority on the goal of reducing coordination time and effort than on the goals of reducing impact on flight operators.

Figure 9A:
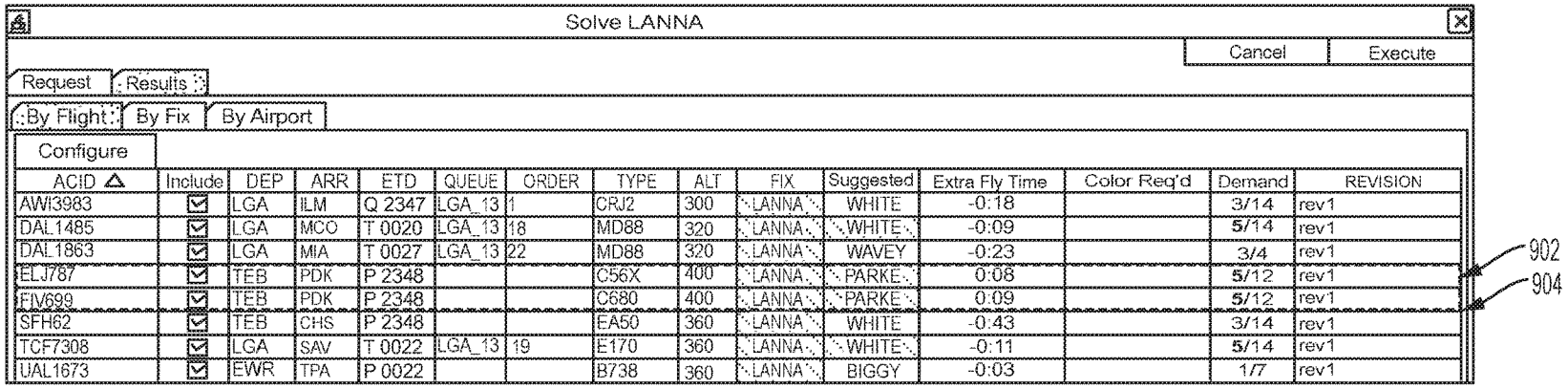
FIG. 9A illustrates alternate departure routes based on considering coordination cost, according to a third operational example.

FIG. 9A shows the optimization results of a system using the modified weights. The results include eight flights that are selected for reroutes. Comparing FIG. 9A to FIG. 7B shows that the two flights in FIG. 7B that required coordination (as shown in column 732 of FIG. 7B) are removed from the candidate list shown in FIG. 9A, and two alternate flights (902 and 904) are rerouted instead. This results in four reroutes over WHITE, two over PARKE, one over WAVEY, and one over BIGGY.

FIG. 9B provides a comparison of the planned fix demand count table 700 of FIG. 7A side by side with the rerouting fix demand count table 900 generated by the system based on the modified weights. Comparing FIG. 9B to FIG. 7C shows that the congestion profile on LANNA remains the same as before, and, therefore, the only change is the flights selected for reroutes and the alternate departure fixes selected. According to some embodiments, changing the objective function weighting will only change the structure of the solution and not improve the congestion resolution (for example, as shown by the comparison between FIG. 9B and FIG. 7C), because the system can find a solution that resolves the congestion if it exists, regardless of the weighting used.

Figure 10:
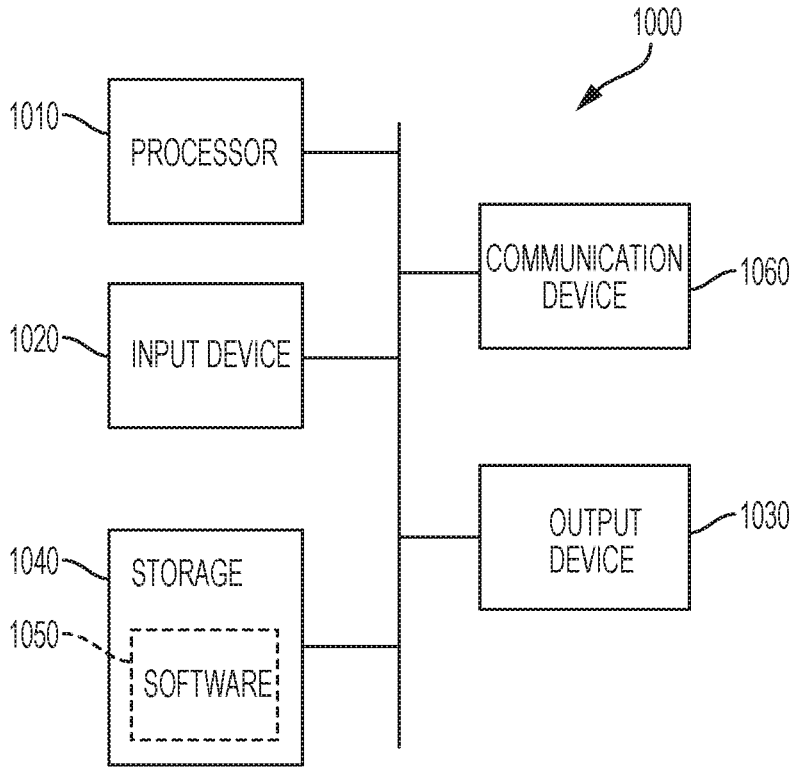
FIG. 10 illustrates an example of a computer in accordance with one embodiment.

FIG. 10 illustrates an example of a computer in accordance with one embodiment. Computer 1000 can be a component of a system for identifying departure reroutes according to the systems and methods described above, such as system 200 of FIG. 2, or can include the entire system itself. In some embodiments, computer 1000 is configured to perform a method for identifying departure reroutes, such as method 500 of FIG. 5.

Computer 1000 can be a host computer connected to a network. Computer 1000 can be a client computer or a server. As shown in FIG. 10, computer 1000 can be any suitable type of microprocessor-based device, such as a personal computer, workstation, server, or handheld computing device, such as a phone or tablet. The computer can include, for example, one or more of processor 1010, input device 1020, output device 1030, storage 1040, and communication device 1060. Input device 1020 and output device 1030 can generally correspond to those described above and can either be connectable or integrated with the computer.

Input device 1020 can be any suitable device that provides input, such as a touch screen or monitor, keyboard, mouse, or voice-recognition device. Output device 1030 can be any suitable device that provides output, such as a touch screen, monitor, printer, disk drive, or speaker.

Storage 1040 can be any suitable device that provides storage, such as an electrical, magnetic, or optical memory, including a RAM, cache, hard drive, CD-ROM drive, tape drive, or removable storage disk. Communication device 1060 can include any suitable device capable of transmitting and receiving signals over a network, such as a network interface chip or card. The components of the computer can be connected in any suitable manner, such as via a physical bus or wirelessly. Storage 1040 can be a non-transitory computer readable storage medium comprising one or more programs, which, when executed by one or more processors, such as processor 1310, cause the one or more processors to perform methods described herein, such as method 500 of FIG. 5.

Software 1050, which can be stored in storage 1040 and executed by processor 1310, can include, for example, the programming that embodies the functionality of the present disclosure (e.g., as embodied in the systems, computers, servers, and/or devices as described above). In some embodiments, software 1050 can include a combination of servers such as application servers and database servers.

Software 1050 can also be stored and/or transported within any computer-readable storage medium for use by or in connection with an instruction execution system, apparatus, or device, such as those described above, that can fetch instructions associated with the software from the instruction execution system, apparatus, or device and execute the instructions. In the context of this disclosure, a computer-readable storage medium can be any medium, such as storage 1040, that can contain or store programming for use by or in connection with an instruction execution system, apparatus, or device.

Software 1050 can also be propagated within any transport medium for use by or in connection with an instruction execution system, apparatus, or device, such as those described above, that can fetch instructions associated with the software from the instruction execution system, apparatus, or device and execute the instructions. In the context of this disclosure, a transport medium can be any medium that can communicate, propagate, or transport programming for use by or in connection with an instruction execution system, apparatus, or device. The transport readable medium can include, but is not limited to, an electronic, magnetic, optical, electromagnetic, or infrared wired or wireless propagation medium.

Computer 1000 may be connected to a network, which can be any suitable type of interconnected communication system. The network can implement any suitable communications protocol and can be secured by any suitable security protocol. The network can comprise network links of any suitable arrangement that can implement the transmission and reception of network signals, such as wireless network connections, T1 or T3 lines, cable networks, DSL, or telephone lines.

Computer 1000 can implement any operating system suitable for operating on the network. Software 1050 can be written in any suitable programming language, such as C, C++, Java, or Python. In various embodiments, application software embodying the functionality of the present disclosure can be deployed in different configurations, such as in a client/server arrangement or through a Web browser as a Web-based application or Web service, for example.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated by reference.

What is claimed as new and desired to be protected by Letters Patent of the United States is:

1. A system for identifying departure reroutes comprising:
one or more processors;
memory; and
one or more programs, wherein the one or more programs are stored in the memory and configured to be executed by the one or more processors, the one or more programs including instructions for:
storing a plurality of planned departures associated with departure routes and departure fixes in the memory;
storing at least one constraint associated with one or more of the departure routes and departure fixes in the memory;
generating a departure model for modifying the plurality of planned departures based on the at least one constraint, wherein the departure model comprises a directed graph representing the plurality of planned departures, the departure routes, and the departure fixes;
determining an optimized set of flows through the departure model based on the at least one constraint; and
identifying a reroute for at least one planned departure based on the optimized set of flows.

2. The system of claim 1, wherein the directed graph is a flow network.

3. The system of claim 1, wherein:
the departure model comprises:
a plurality of departure nodes associated with the plurality of planned departures;
a plurality of route nodes associated with the departure routes;
a plurality of first fix nodes associated with the departure fixes;
a plurality of first connections between the plurality of departure nodes and the plurality of route nodes; and
a plurality of second connections between the plurality of route nodes and the plurality of first fix nodes;
at least one factor assigned to at least one of the first and second connections based on the at least one constraint; and
determining an optimized set of flows through the departure model based on the at least one constraint comprises determining an optimized set of flows through the departure model based on the plurality of first connections, the plurality of second connections, and the at least one factor.

4. The system of claim 3, wherein the plurality of departure nodes, the plurality of route nodes, and the plurality of first fix nodes are grouped into time bins.

5. The system of claim 4, wherein connections of the plurality of first connections and the plurality of second connections are limited to connections between nodes grouped in the same time bin.

6. The system of claim 5, wherein the model comprises:

a plurality of second fix nodes associated with the departure fixes; and a plurality of third connections between the plurality of first fix nodes and the plurality of second fix nodes, wherein at least one second fix node is connected to a first fix node grouped in a first time bin and a first fix node grouped in a second time bin.

7. The system of claim 1, wherein a planned departure of the plurality of planned departures comprises:

a planned departure time for an asset to depart a departure location; and a planned departure route for routing the asset from the departure location to a planned departure fix.

8. The system of claim 7, wherein the departure location is a region comprising multiple departure installations.

9. The system of claim 3, wherein the plurality of route nodes comprises at least one node for each first fix node.

10. The system of claim 3, wherein the at least one factor comprises a limit on a quantity of flows through a node.

11. The system of claim 1, wherein the at least one constraint is associated with a weather event.

12. The system of claim 3, wherein the model comprises multipliers for the connections that represent at least one operational characteristic.

13. The system of claim 12, wherein the at least one operational characteristic comprises at least one of travel time, rerouting, and weather blockage.

14. The system of claim 1, wherein determining an optimized set of flows comprises determining the optimized set of flows using a linear or network optimization algorithm.

15. The system of claim 1, wherein the optimized set of flows comprises a minimum total value.

16. The system of claim 1, wherein in response to changes to the at least one constraint, the system automatically updates the departure model and automatically determines an updated optimized set of flows.

17. A method for identifying departure reroutes comprising:

storing a plurality of planned departures associated with departure routes and departure fixes in a memory;

storing at least one constraint associated with one or more of the departure routes and departure fixes in the memory;

generating, by a processor, a departure model for modifying the plurality of planned departures based on the at least one constraint, wherein the departure model comprises a directed graph representing the planned departures, the departure routes, and the departure fixes;

determining, by the processor, an optimized set of flows through the departure model based on the at least one constraint; and identifying a reroute for at least one planned departure based on the optimized set of flows.

18. The method of claim 17, wherein the directed graph is a flow network.

19. The method of claim 17, wherein:

the departure model comprises:

a plurality of departure nodes associated with the plurality of planned departures;

a plurality of route nodes associated with the departure routes;

a plurality of first fix nodes associated with the departure fixes;

a plurality of first connections between the plurality of departure nodes and the plurality of route nodes; and a plurality of second connections between the plurality of route nodes and the plurality of first fix nodes;

at least one factor assigned to at least one of the first and second connections based on the at least one constraint; and determining an optimized set of flows through the departure model based on the at least one constraint comprises determining an optimized set of flows through the departure model based on the plurality of first connections, the plurality of second connections, and the at least one factor.

20. The method of claim 19, wherein the plurality of departure nodes, the plurality of route nodes, and the plurality of first fix nodes are grouped into time bins.

21. The method of claim 20, wherein connections of the plurality of first connections and the plurality of second connections are limited to connections between nodes grouped in the same time bin.

22. The method of claim 21, wherein the model comprises:

a plurality of second fix nodes associated with the departure fixes; and a plurality of third connections between the plurality of first fix nodes and the plurality of second fix nodes, wherein at least one second fix node is connected to a first fix node grouped in a first time bin and a first fix node grouped in a second time bin.

23. The method of claim 17, wherein a planned departure comprises:

a planned departure time for an asset to depart a departure location; and a planned departure route for routing the asset from the departure location to a planned departure fix.

24. The method of claim 23, wherein the departure location is a region comprising multiple departure installations.

25. The method of claim 19, wherein the plurality of route nodes comprises at least one node for each first fix node.

26. The method of claim 19, wherein the at least one factor comprises a limit on a quantity of flows through a node.

27. The method of claim 17, wherein the at least one constraint is associated with a weather event.

28. The method of claim 19, wherein the model comprises multipliers for the connections that represent at least one operational characteristic.

29. The method of claim 28, wherein the at least one operational characteristic comprises at least one of travel time, rerouting, and weather blockage.

30. The method of claim 17, wherein determining an optimized set of flows comprises determining the optimized set of flows using a linear or network optimization algorithm.

31. The method of claim 17, wherein the optimized set of flows comprises a minimum total value.

32. The method of claim 17, wherein in response to changes to the at least one constraint, the departure model is automatically updated and an updated optimized set of flows is determined.

33. A non-transitory computer readable storage medium comprising one or more programs, which when executed by one or more processors, cause the one or more processors to perform a method comprising:

storing a plurality of planned departures associated with departure routes and departure fixes in a memory;

storing at least one constraint associated with one or more of the departure routes and departure fixes in the memory;

generating a departure model for modifying the plurality of planned departures based on the at least one constraint, wherein the departure model comprises a directed graph representing the planned departures, the departure routes, and the departure fixes;

determining an optimized set of flows through the departure model based on the at least one constraint; and identifying a reroute for at least one planned departure based on the optimized set of flows.

34. A system for managing departures comprising:

a communication network;

a first system connected to the communication network and comprising one or more first processors and first memory, wherein the first system is configured to manage departures by maintaining departure routing information and departure resource information; and a second system connected to the communication network and comprising one or more second processors, second memory, and one or more programs, wherein the one or more programs are stored in the second memory and configured to be executed by the one or more second processors, the one or more programs including instructions for:

receiving a plurality of planned departures associated with departure routes and departure fixes from the first system;

receiving at least one constraint associated with one or more of the departure routes and departure fixes from the first system;

generating a departure model for modifying the plurality of planned departures based on the at least one constraint, wherein the departure model comprises a directed graph representing the planned departures, the departure routes, and the departure fixes;

determining an optimized set of flows through the departure model based on the at least one constraint;

identifying a reroute for at least one planned departure based on the optimized set of flows; and transmitting the identified reroute to the first system over the communication network, wherein the first system updates the departure routing information based on the identified reroute received from the second system.

* * * * *